US010689981B2

(12) United States Patent
Hall et al.

(10) Patent No.: US 10,689,981 B2
(45) Date of Patent: Jun. 23, 2020

(54) METHOD OF MOVING MATERIAL

(71) Applicant: OPTI-MINEZ PTY LTD, Queensland (AU)

(72) Inventors: David John Hall, Queensland (AU); Cameron Albert Mitchell Voss, Queensland (AU); Lachlan Yeldham, Queensland (AU)

(73) Assignee: OPTI-MINEZ PTY LTD, Queensland (AU)

( * ) Notice: Subject to any disclaimer, the term of this patent is extended or adjusted under 35 U.S.C. 154(b) by 226 days.

(21) Appl. No.: 15/507,575

(22) PCT Filed: Aug. 28, 2015

(86) PCT No.: PCT/AU2015/000526
§ 371 (c)(1),
(2) Date: Feb. 28, 2017

(87) PCT Pub. No.: WO2016/033634
PCT Pub. Date: Mar. 10, 2016

(65) Prior Publication Data

US 2017/0284200 A1 Oct. 5, 2017

(30) Foreign Application Priority Data

Sep. 1, 2014 (AU) ..... 2014903481
Nov. 19, 2014 (AU) ..... 2014904643

(51) Int. Cl.
*E21C 41/26* (2006.01)
*E21C 41/28* (2006.01)
(Continued)

(52) U.S. Cl.
CPC ..... *E21C 47/02* (2013.01); *E02F 3/76* (2013.01); *E21C 37/00* (2013.01); *E21C 41/00* (2013.01);
(Continued)

(58) Field of Classification Search
CPC ..... E21C 41/28; E21C 47/02; E21C 41/26; E21C 47/00; E21C 41/32; E21C 41/00;
(Continued)

(56) References Cited

U.S. PATENT DOCUMENTS 1,684,147 A * 9/1928 Roberts ..... E21C 41/00 37/195
3,762,771 A 10/1973 Livingston
(Continued)

FOREIGN PATENT DOCUMENTS

| | | |
|---|---|---|
| AU | 2003266820 | 10/2009 |
| CN | 102606160 | 7/2012 |
| WO | 2007076571 | 7/2007 |

OTHER PUBLICATIONS

Written Opinion for International Application No. PCT/AU2015/000526 dated Sep. 24, 2015.

*Primary Examiner* — David J Bagnell
*Assistant Examiner* — Michael A Goodwin
(74) *Attorney, Agent, or Firm* — Wegman Hessler

(57) ABSTRACT

The invention is directed to a method of strip mining that involves dividing the pit into blocks in a diamond shape arrangement with an angular advancing strike face and removing waste material from each diagonally adjacent block so as to minimize the amount of waste material pushed by dozers and maintain the incline of ramps to gradients of 10% or less so that trucks can take mined ore from the pit.

10 Claims, 45 Drawing Sheets

(51) Int. Cl.

| | |
|---|---|
| ***E21C 47/02*** | (2006.01) |
| ***E21F 13/02*** | (2006.01) |
| ***E21C 41/00*** | (2006.01) |
| ***E02F 3/76*** | (2006.01) |
| ***E21C 37/00*** | (2006.01) |
| *E21C 41/32* | (2006.01) |

(52) U.S. Cl.
CPC ..... *E21C 41/26* (2013.01); *E21C 41/28* (2013.01); *E21F 13/02* (2013.01); *E21C 41/32* (2013.01)

(58) Field of Classification Search
CPC ..... E21C 41/04; E21C 41/10; E21C 41/14; E21C 41/30; E21C 41/31; E21C 47/04; E21C 47/06; E21C 47/08
USPC ..... 299/19, 11, 12
See application file for complete search history.

(56) References Cited

U.S. PATENT DOCUMENTS

| | | | | | |
|---|---|---|---|---|---|
| 4,133,581 | A * | 1/1979 | Satterwhite | E21C 47/00 | 299/18 |
| 4,345,680 | A * | 8/1982 | Kay | B65G 41/002 | 198/302 |
| 4,624,504 | A * | 11/1986 | Franke | E21C 47/04 | 299/18 |
| 5,194,689 | A * | 3/1993 | Cummins | E21C 41/26 | 102/302 |
| 5,413,047 | A * | 5/1995 | Evans | E21C 41/26 | 102/302 |
| 5,427,439 | A * | 6/1995 | Herickhoff | B65G 65/28 | 299/18 |
| 2008/0093911 | A1* | 4/2008 | Drummond | B65G 41/008 | 299/18 |
| 2008/0290718 | A1* | 11/2008 | Zukerberg | B09B 1/00 | 299/1.9 |

* cited by examiner

Fig. 38

| | Normal 1 Cut | Normal 1 Fill | Normal 2 Cut | Normal 2 Fill |
|---|---|---|---|---|
| Volume moved BCM | 52,500 | 52,500 | 52,500 | 52,500 |
| Average Distance | 31.06m | 61.47m | 31.06m | 67.92m |
| Average gradient | -33.80% | 8.73% | -33.80% | 16.09% |
| Time | 39.4hrs | 140.5hrs | 39.4hrs | 195.2hrs |
| Cost | $15,768 | $56,190 | $15,768 | $78,078 |
| Total Cost | $165,803.9 | | | |
| Cost per $m^3$ (BCM) | $1.58 | | | |

Fig. 39

| | 45 Low Cut | 45 Low Fill | 45 High Cut | 45 High Fill |
|---|---|---|---|---|
| Volume moved LCM | 50,000 | 50,000 | 55,000 | 55,000 |
| Average Distance | 27.89m | 41.97m | 28.18m | 50.58m |
| Average gradient | -17.93% | 7.81% | -19.52% | 1.51% |
| Time | 39.7hrs | 92.6hrs | 43.8hrs | 103.8hrs |
| Cost | $15,884 | $37,047 | $17,525 | $41,537 |
| Total Cost | $111,992.4 | | | |
| Cost per $m^3$ (BCM) | $1.07 | | | |

Fig. 48

| Block | | | Base cost using Diamond Method with Dozers | | | | |
|---|---|---|---|---|---|---|---|
| W | L | D | BCM | | Rate / BCM | | Cost |
| 50 | 50 | 21 | 52,500 | $ | | 1.07 | $ 56,175.00 |
| **Block** | | | **Dozer only with extra push lenghts and distances** | | | | |
| **W** | **L** | **D** | **BCM** | | **Rate / BCM** | | **Cost** |
| 50 | 50 | 40 | 100,000 | $ | | 1.27 | $ 127,000.00 |
| **Combination of Trucks and Dozers** | | | | | | | |
| Rock removed with Trucks | | | 47,500 | $ | | 2.40 | $ 114,000.00 |
| Dozers | | | 52,500 | $ | | 1.07 | $ 56,175.00 |
| **Total cost for Block** | | | | | | | **$ 170,175.00** |

| | BCM Rate | Total Cost |
|---|---|---|
| Average cost per BCM combined dozers and trucks | **$ 1.70** | $ 170,175.00 |
| Truck costs | $ 2.40 | $ 240,000.00 |
| Savings against all truck BCM and total | $ 0.70 | $ 69,825.00 |

METHOD OF MOVING MATERIAL

CROSS REFERENCE TO RELATED APPLICATIONS

This application is a national phase of International Patent Application No. PCT/AU2015/000526 filed Aug. 28, 2015, which claims the priority filing benefit of Australian Patent Application Nos. AU2014903481 filed Sep. 1, 2014 and AU2014904643 filed Nov. 19, 2014, both of which are incorporated herein by reference in their entirety.

FIELD OF INVENTION

The present invention relates to moving earth including dirt, rock and like material using a dozer blade. The present invention has particular but not exclusive application in moving earth in mining operations. Reference to mining operations is by way of example only and the invention is not limited to mining operations.

BACKGROUND OF THE INVENTION

Strip mining is a method of removing the waste rock from above the ore body in strips to expose the ore to be mined and depositing the waste rock in the void of the previously mined strip. The strip mining method usually starts with a box cut, which removes the waste rock from above the ore body to another location. The ore is mined and the miners move to another strip. With the new strip the waste rock is deposited in the void created from the previously mined strip. The method is repeated as the mining operation continues to advance. For most strip mining, waste rock is blasted before removal but in some areas it is removed using earthmoving equipment large enough to penetrate the material without blasting.

The pit design for strip mining is usually a long advancing face uncovering the ore with a dump area following the advancing face. As the material is removed from the advancing face it is placed into a dump area void that was created from the previous advancing face.

The strip mining method often employs different equipment to remove rock waste. It is common in large operations that before or after blasting, a pre-strip cut is made by a truck and shovel fleet and or a dragline will take multiple passes to move the waste rock into the dump position. In some mines, dozers are used to assist the dragline in removing the waste rock. In some mining operations dozers are used as a primary digging tool and they have a dedicated fleet of dozers for the dozer push task.

Pit design takes into consideration what equipment is used for the mining method. The pit design for strip mining in many cases has the waste rock moved directly across the pit when draglines are used. When a truck and shovel operation is used the waste rock must be carried out of the pit and along roadways. The loaded trucks can only travel up roadways that are not too steep.

Strip mining has evolved and one of the most effective earth moving equipment in strip mining has become the bulldozer. The method of moving earth with a bulldozer is commonly referred to as dozer push. However dozers are limited to pushing short distances and are less effective when pushing uphill as opposed to pushing downhill. Dozing is generally limited to a 25% to 30% grade to push material uphill.

More commonly the truck and shovel are used to remove waste rock. The shovel may have an excavator configuration or a face shovel configuration. Its operation is restricted to a grade that the trucks can drive up when fully loaded. This usually means the trucks must drive from the pit where they are loaded, up a ramp and onto the waste dump. As a general rule, trucks are limited to traveling up a 10% uphill grade when fully loaded. The area in which they are loaded and the area in which they are unloaded generally needs to be flat. This increases the length of travel needed to lift any load upwards at a 10% grade.

As a comparison, dozers need less distance to lift material to a given height than a truck. However if the lift height becomes too great, the dozer loses its advantage because it becomes less effective with increasing push lengths. Dozers do have another advantage in that they do not need a flat area in which to load or unload. This reduces the total length needed to lift material when compared to trucks.

Both dozer and truck/shovel mining methods have increased costs when the material has to be lifted higher to the waste dump area. It is therefore an advantage to reduce the lift height of the waste material. The decision to use dozers is one of commercial feasibility and depends on a number of factors including the ore body position (including length and depth) and steepness of gradients.

Object of the Invention

It is an object of the present invention to provide an alternate method of moving earth using a dozer that overcomes at least in part one or more of the disadvantages mentioned above.

BRIEF DESCRIPTION OF THE DRAWINGS

FIGS. 38-39 illustrate example push data, in accordance with aspects of the disclosure;

FIG. 48 illustrates an example return on investment calculation, in accordance with aspects of the disclosure.

SUMMARY OF THE INVENTION

Figure 1:
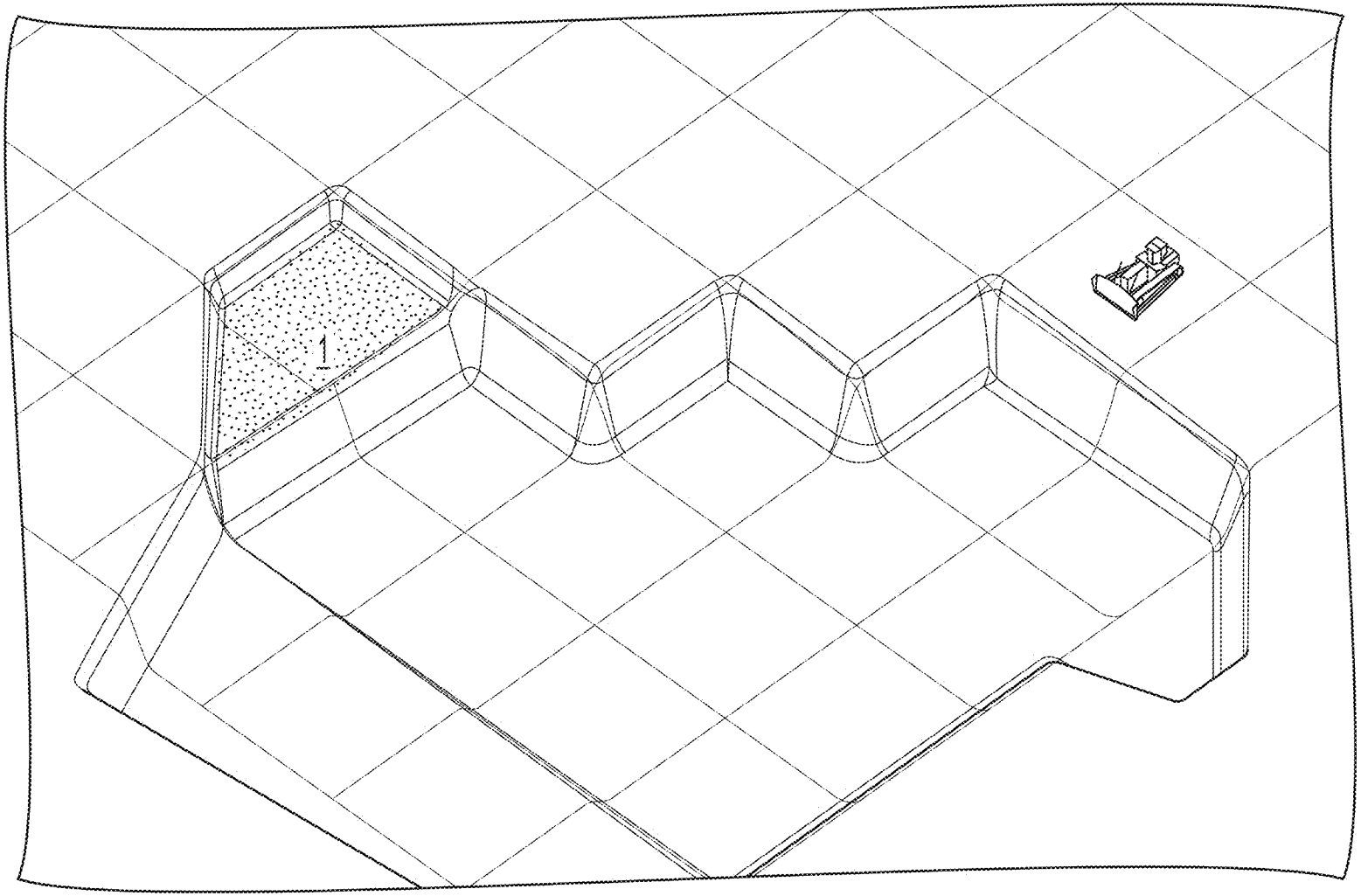
FIGS. 1-15 illustrate exemplary work sites, in accordance with aspects of the disclosure.

The present invention was developed from trial and experimentation in the design of a series of consecutive dozer pushes that provide a commercial advantage over conventional methods of dozer pushes. The invention was developed by recognising a pattern in the dozer pushes with respect to different environments and conditions to provide an overall commercial advantage. From the trial and experimentation and the recognition of a pattern, a method and system was developed to perform a series of dozer pushes for any particular environment and condition that provides a commercial advantage. Commercial advantage includes but not limited to one or more of moving comparatively more earth, moving the same volume of earth in comparatively less time, and moving a volume of earth while consuming a comparatively less amount of fuel.

The method involves designing the pit in a diamond pattern with a series of blocks that are not in a straight advancing face. The use of the diamond pattern reduces the amount of waste rock being moved into a lower or higher position. Furthermore the diamond pattern provides the advantage that waste rock needs to be pushed at a comparatively shorter distance.

Conventional methods employ a substantially rectangular strip pattern for mining. With conventional dozer push methods, waste rock must be pushed a certain distance to lift the waste rock to a desired height and this ratio is a limiting factor in designing a pit for dozer push operations.

In one aspect the invention broadly resides in a method of strip mining to mine an ore seam including dividing the pit into a plurality of blocks where each block is orientated along a mining strike length in a diamond pattern formation to present an angular advancing strike face;

moving overlying waste material from a first block of said plurality of blocks to access the ore seam wherein the waste material is divided into an upper cut volume and lower cut volume, the upper cut volume is removed out of the pit and the lower cut volume is moved into a first adjacent pit void;

mining the exposed ore seam in the first block;

identifying a second block of the plurality of blocks that is diagonally orientated with respect to the first block and along the mining strike length;

moving an upper cut volume from the second block to the first block and a lower cut volume of the second block to a second adjacent pit void to expose the ore seam; and mining the exposed ore seam in the second block; wherein the steps of moving waste material and mining the exposed ore as performed with respect to the second block are repeated with the remainder of the plurality of blocks.

The first and second adjacent pit voids are preferably behind the advancing strike face and formed from a previous mining operation.

The method is preferably carried out to move waste material minimal distances and have inclines with a substantially 10% gradient or less.

In one embodiment a front corner of an adjacent block is preferably incorporated into the cut volume to form a roadway to move ore from the pit.

The percentage of dozer and truck and shovel operations usage is preferably dependent on topography and geology including direction and depth of the ore seam.

The diamond pattern preferably has the plurality of blocks orientated at 45 degrees to the advancing strike face but changes to 90 degrees when the dipping angle of the ore seam increases to substantially 10 degrees and higher.

The length of the blocks along the advancing strike face can preferably be extended as the dipping angle of the ore seam increases so as to maintain an inclined ramp with a maximum gradient of substantially 10 degrees.

Strategic blasting is preferably used to reduce the amount of waste material to be mechanically excavated, facilitate the dozing by casting material in the direction that the dozers will need to push the material, separating and dealing with the upper and lower layers of material differently, and or directing material to a position that allows the formation of a ramp or bridge to transport excavated material from the pit.

Strategic blasting preferably includes placing explosives at two or more locations, arranging the explosives at each location and coordinating the timing of the detonation of the explosives, wherein the two or more locations can be locations at different depths at the work site, spaced locations to effect casting of site faces in different directions and locations that involve a combination of vertical depth and horizontal spacing positioning, wherein the blasting maximizes the casting of the material to facilitate moving the waste material.

In a preferred embodiment the ore seam is a coal seam.

Figure 2:
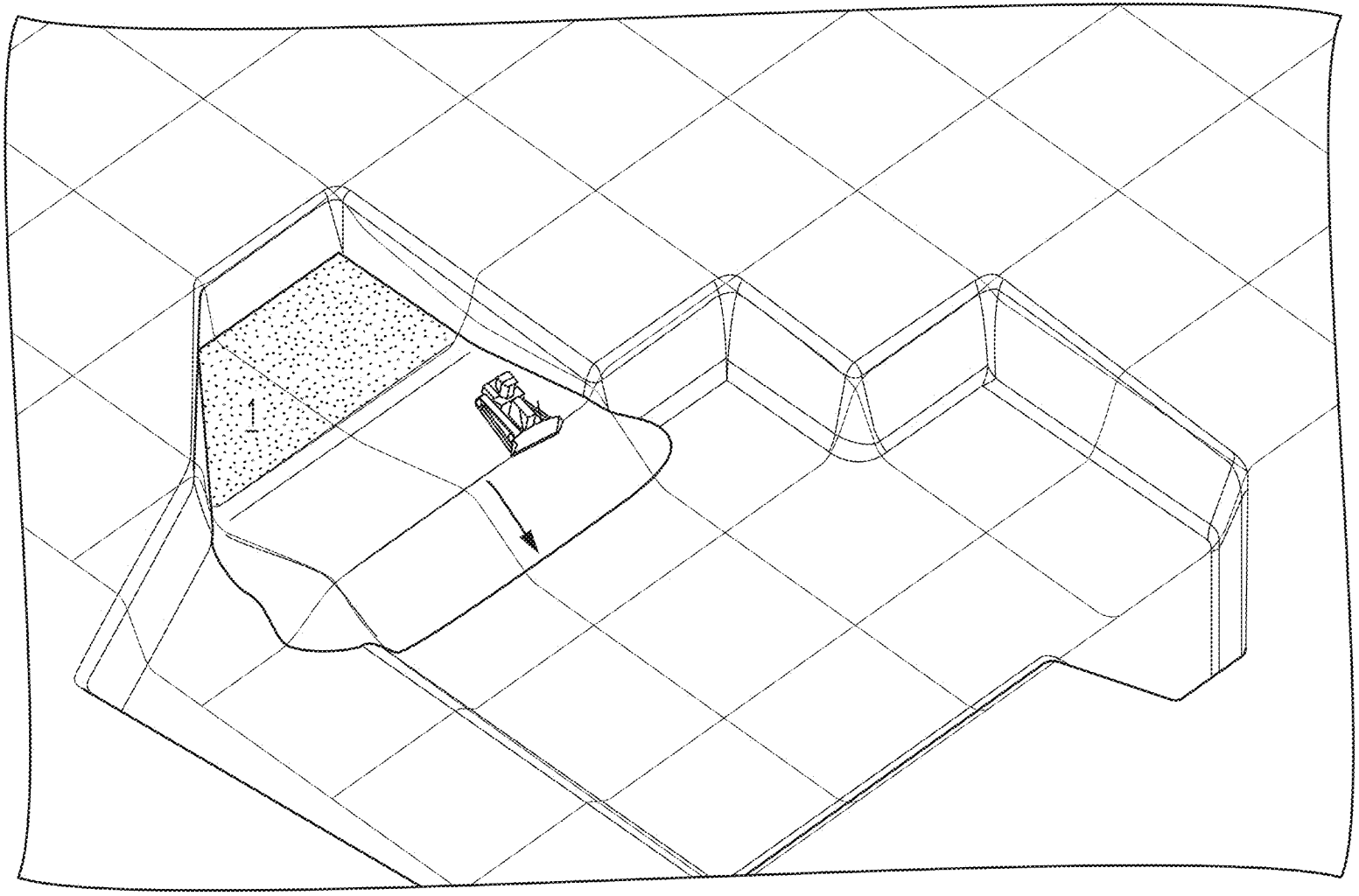
Figure 3:
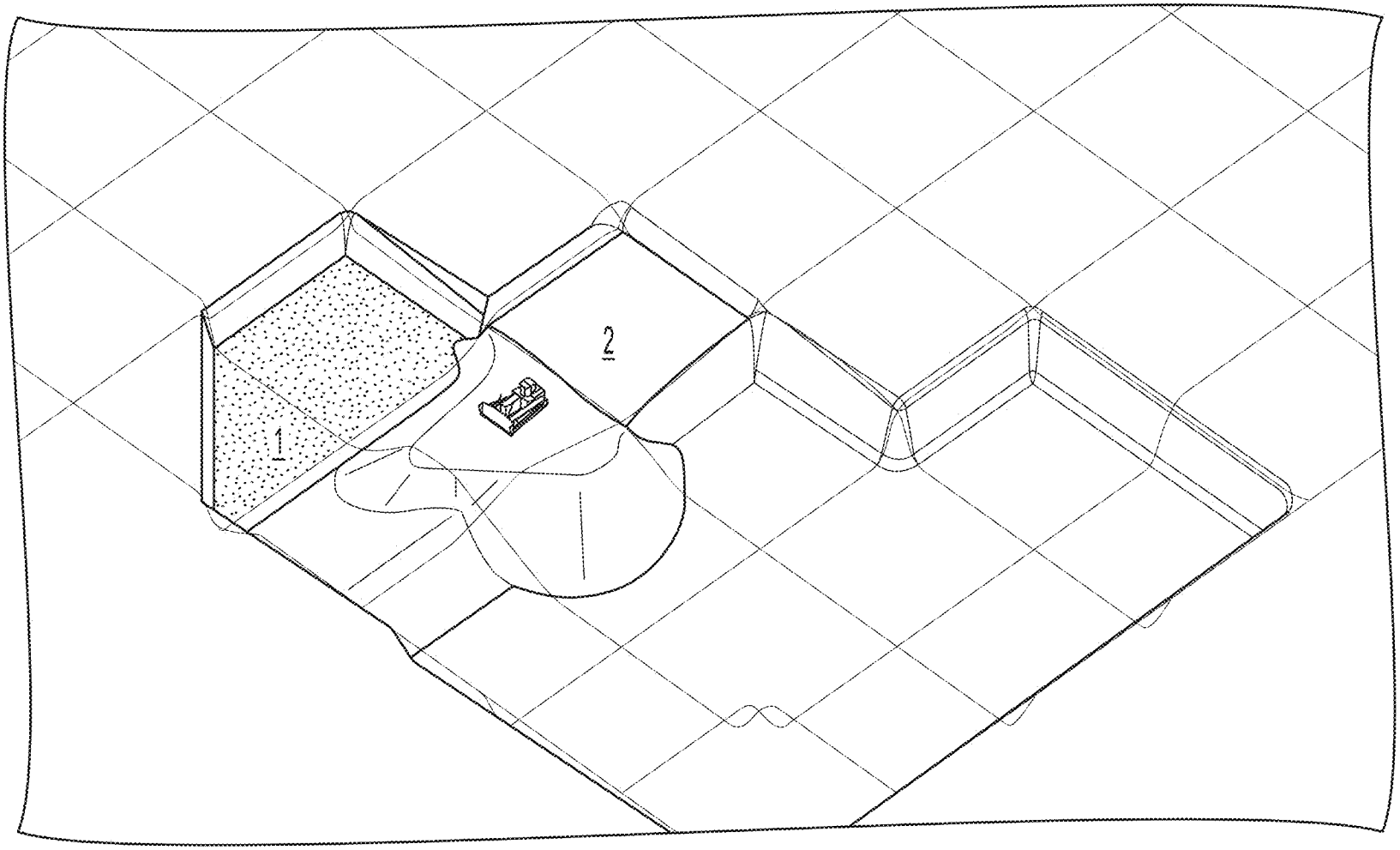
Figure 4:
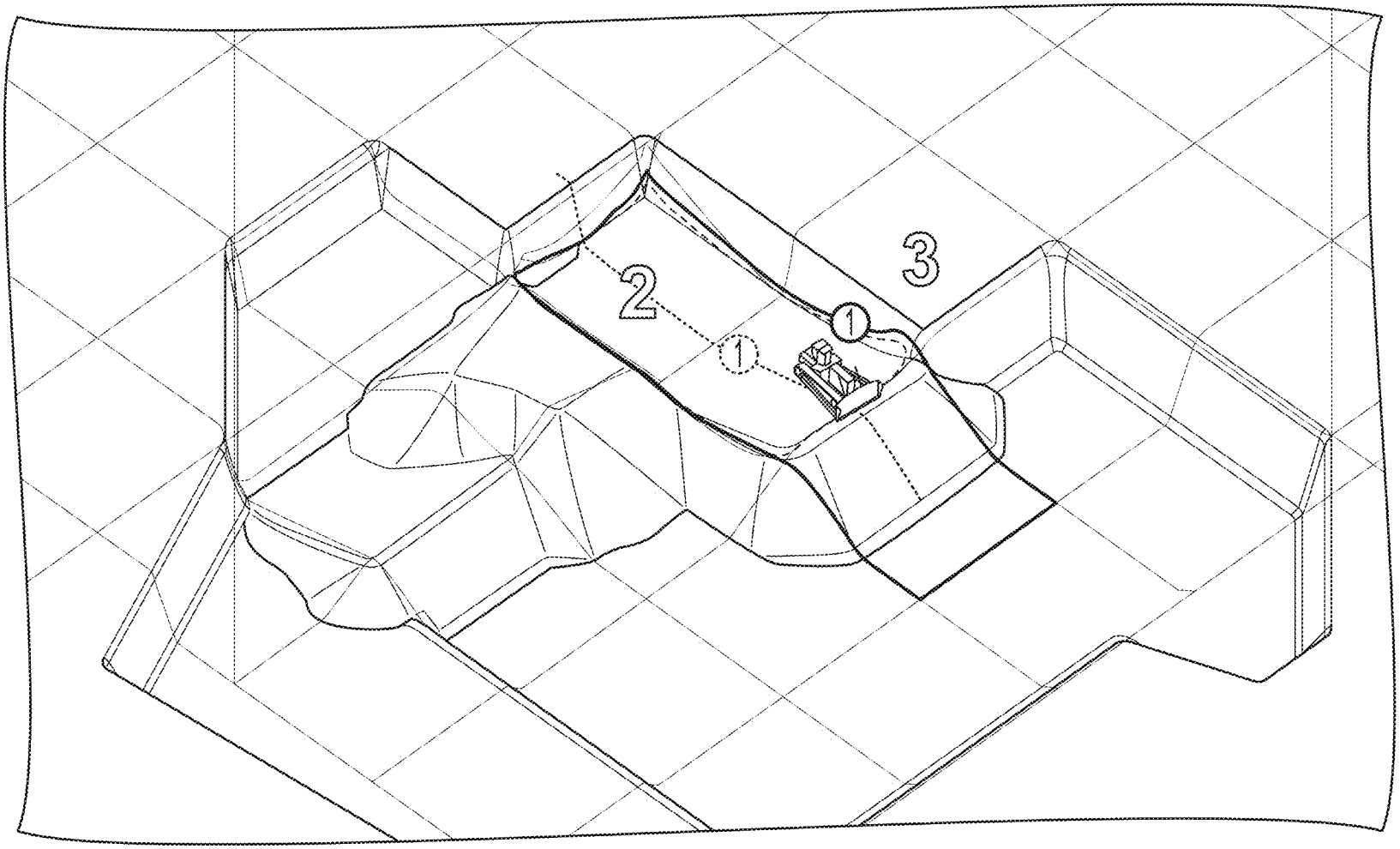
Figure 5:
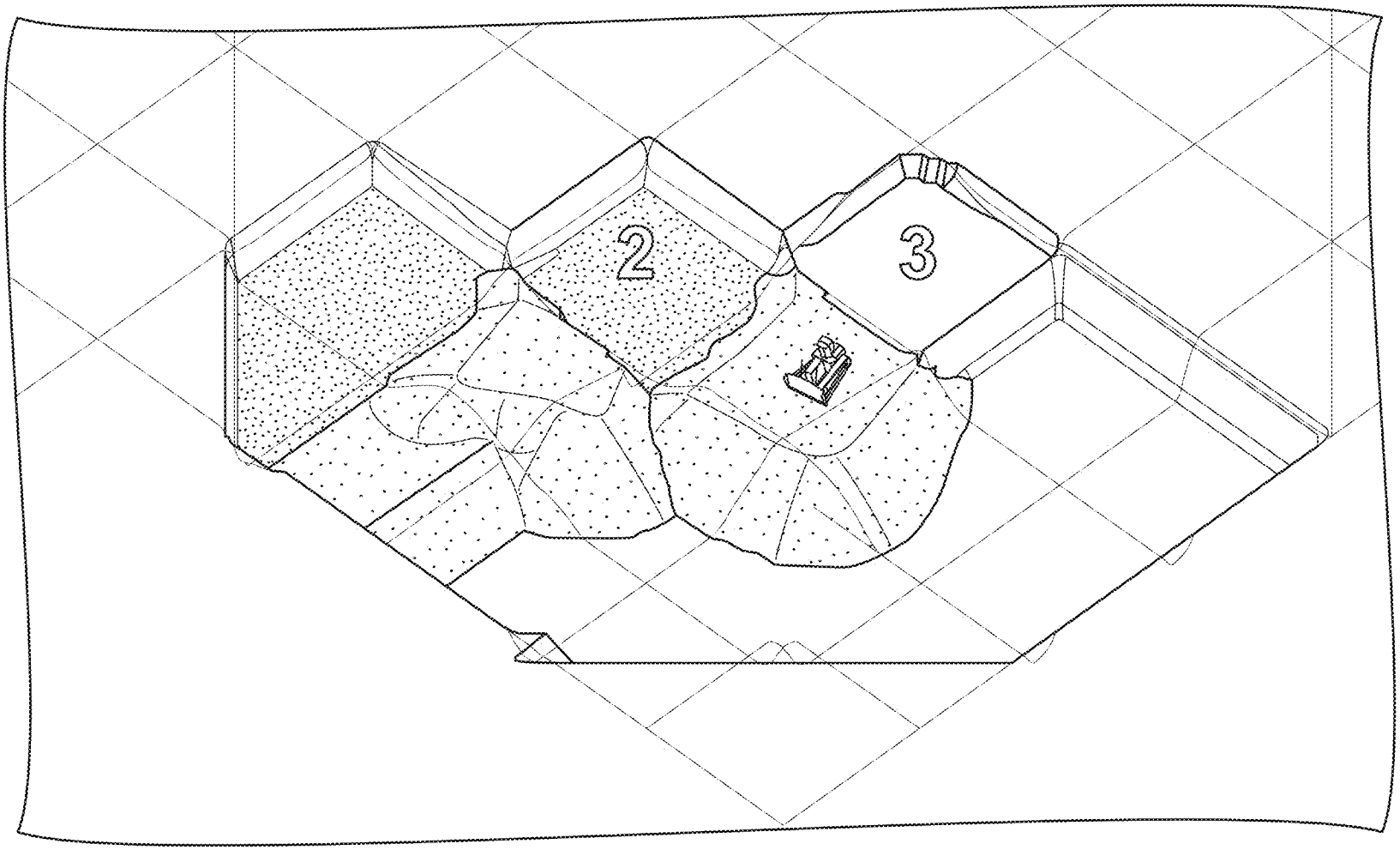

With the present invention the cut volume is divided into an upper volume and a lower volume. To maximise the efficiency of the method the first upper cut volume of block 1 is removed out of the pit void by pushing it to the side or removing it with a truck and shovel operation. This is shown with reference to FIG. 1. With reference to FIGS. 2 and 3, the lower cut volume of block 1 is pushed into the void created from the last mining strip or a box cut. The upper cut volume of the next block 2 is then pushed across the top of the previous bottom fill volume. As shown in FIG. 4, the lower cut volume of block 2 is pushed across the pit into the fill position. In FIG. 5, an upper cut volume of block 3 is then pushed across the top of lower fill volume from block 2. This is repeated across the length of the pit. These repeated steps form the basis of the cross push dozing method.

The method reduces the amount of waste rock that is lifted from a low height to a high height. Another advantage is the reduction of push length that would be needed to lift the material into the waste dump over present methods. Reducing the push length has an added advantage of reducing the disturbed mining footprint area.

If a truck and shovel operation is used in place of the dozers the advantages will be reduced haul lengths for the trucks and reduced lift of material.

Figure 6:
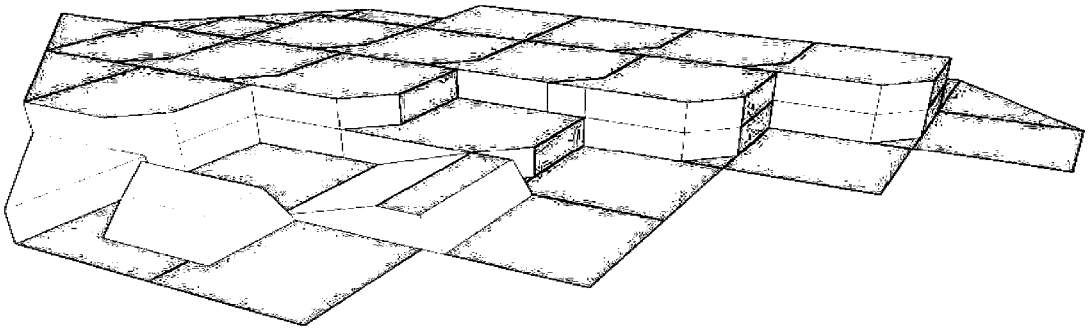

A combination of dozer push and truck and shovel operations can be used. A percentage of truck and shovel operation can be used to optimise the dozer push operation (see FIG. 6).

To allow greater access for the removal of the ore, the blocks may have one front corner incorporated into the cut volume of the block in front of it. When this is carried out and the push sequence is followed it makes room for a roadway behind the waste dump to allow trucks or other equipment removing the ore body to travel between each block.

The method can be used in a number of pit designs taking into consideration the topography and geology including the depth and direction of the ore body.

Figure 7:
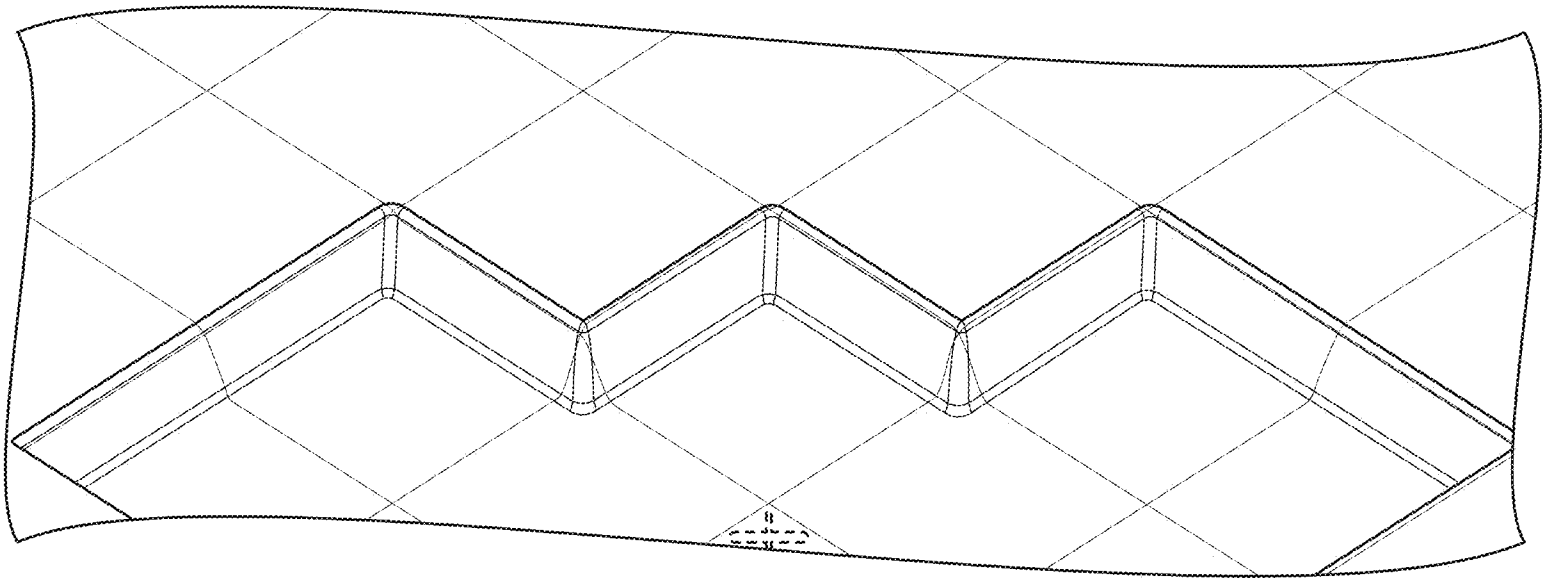

In one form, the pit design may be a diamond pattern diagonal to the advancing mining area (see FIG. 7).

Figure 8:
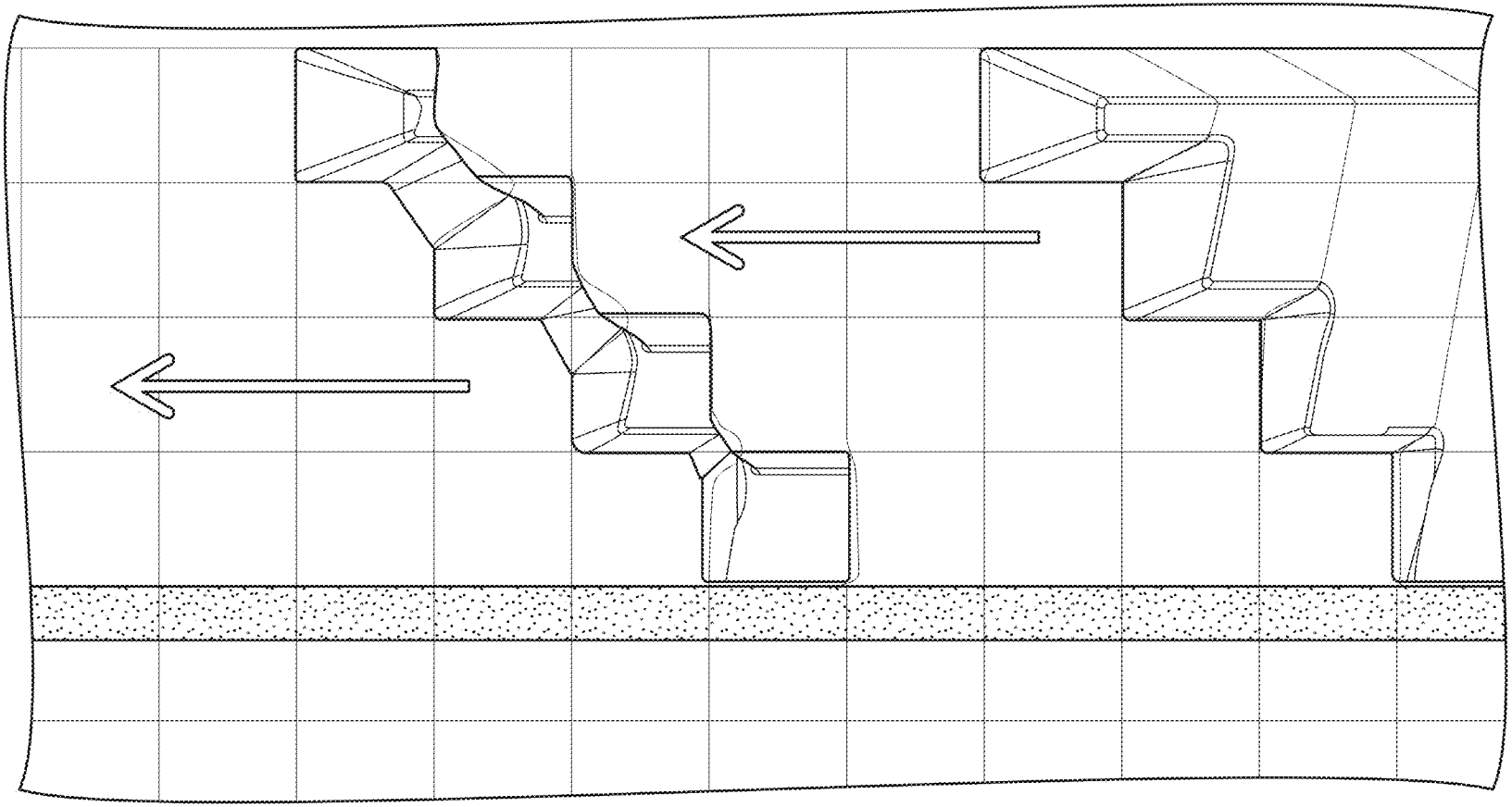

In another form the method can be used having the diamond pattern parallel to the advancing mining area with the mining cut areas mined in a diagonal pattern. These usually have the mining area advancing from an end of the pit (see FIG. 8).

Figure 9:
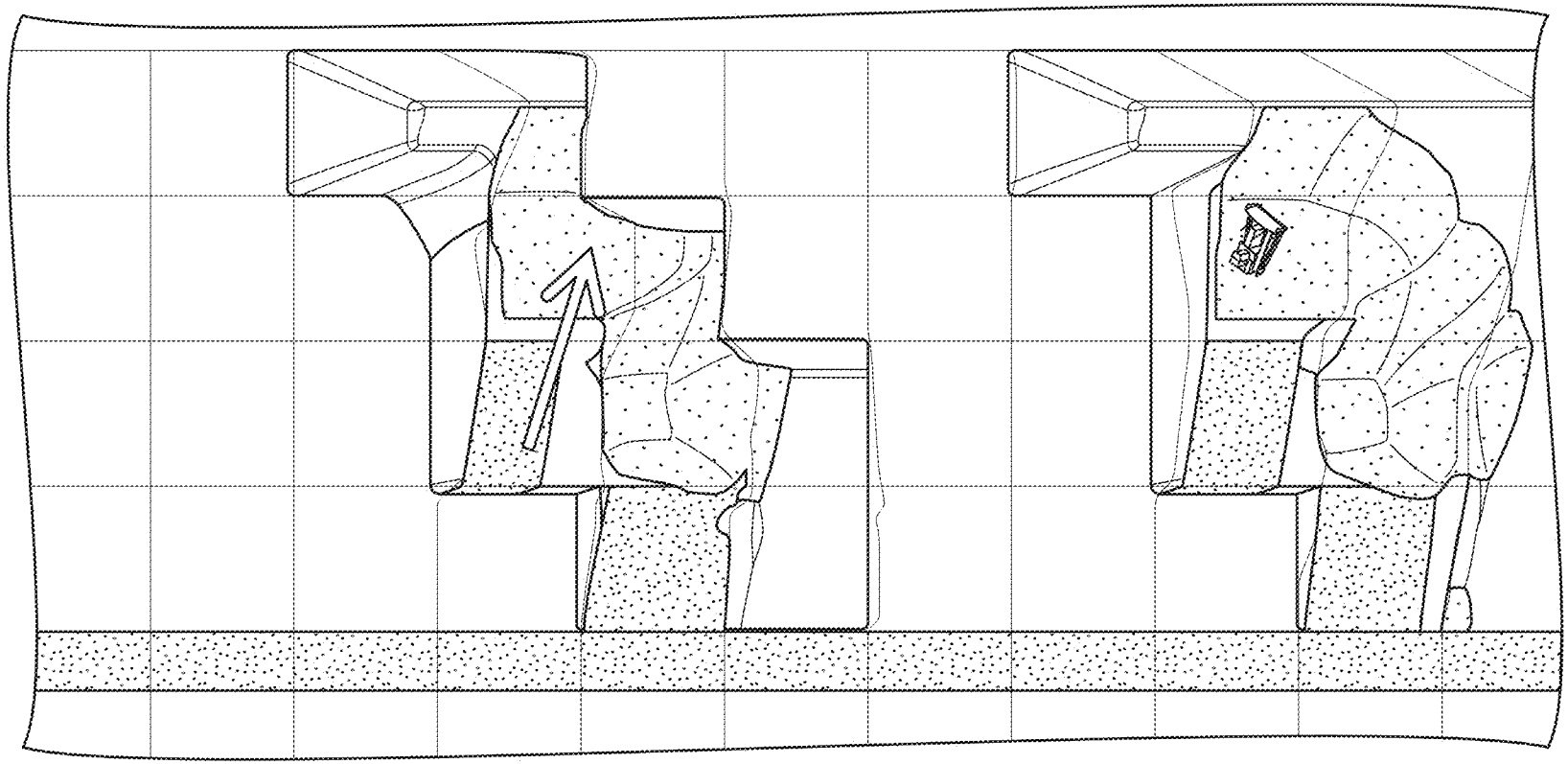

The advantage to this method when used on steep dipping ore bodies is the sequence can take advantage of downhill pushing (see FIG. 9).

One disadvantage of mining steep dipping seams with truck and shovel operations is that the dip may be greater than 10% and difficulties occur from the need to drive a loaded truck out of the pit with either waste rock or mined ore. Ramps are needed to make roadways for the trucks and must be cut into the waste dumps or the cut volumes above the ore body.

Figure 10:
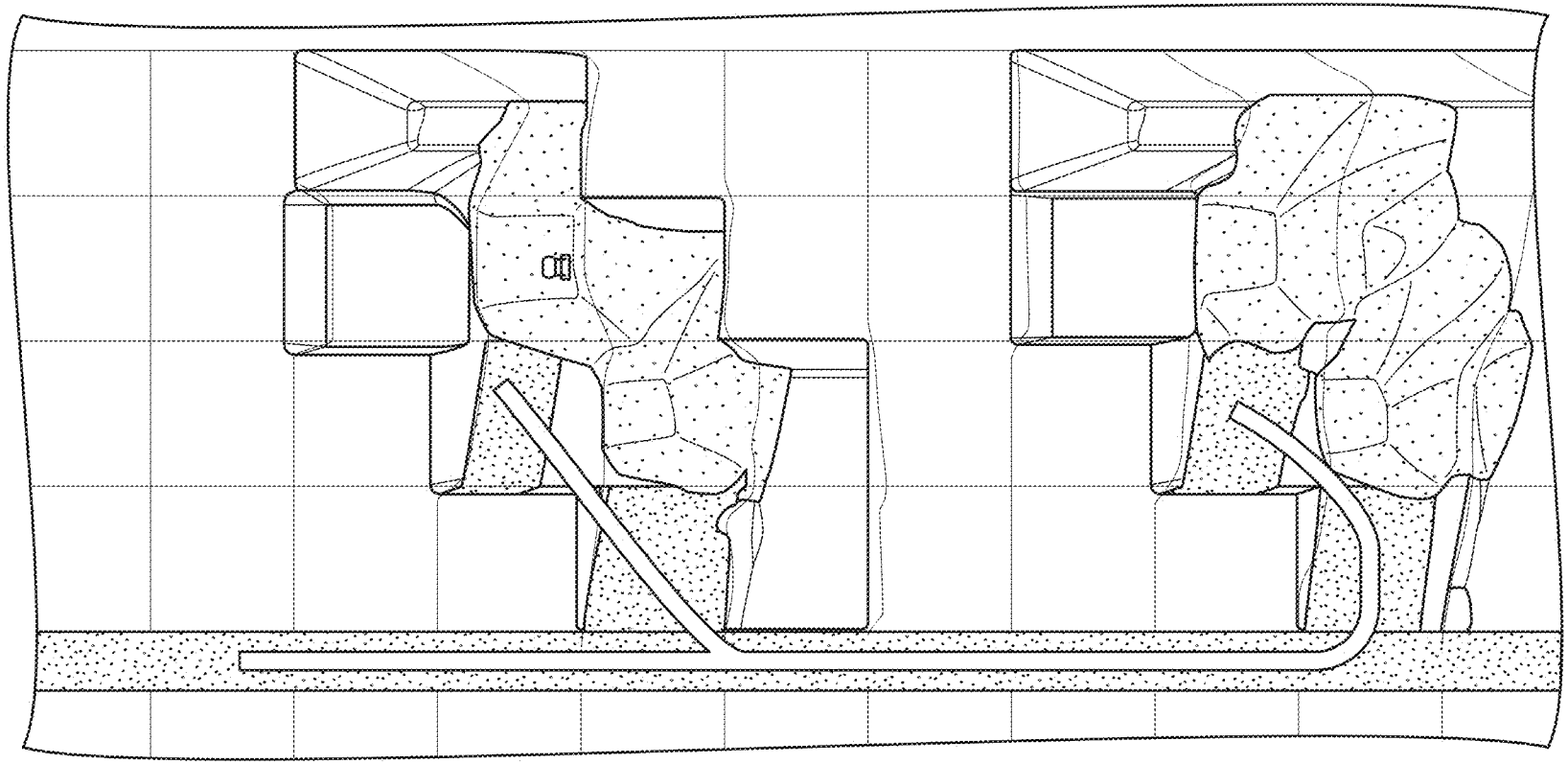

An advantage of the method when used for steep dipping seams of ore or minerals is that the blocks can be arranged so that the diagonal corners from one cut volume to the next lower cut volume are less than the maximum ramp angle for the trucks to drive out of the pit. The advantage in this application is allowing the trucks used to recover the ore or waste to use the void created as a ramp out of the pit. This application and pit design will allow for multiple work faces for waste removal to be mined (see FIG. 10).

Figure 11:
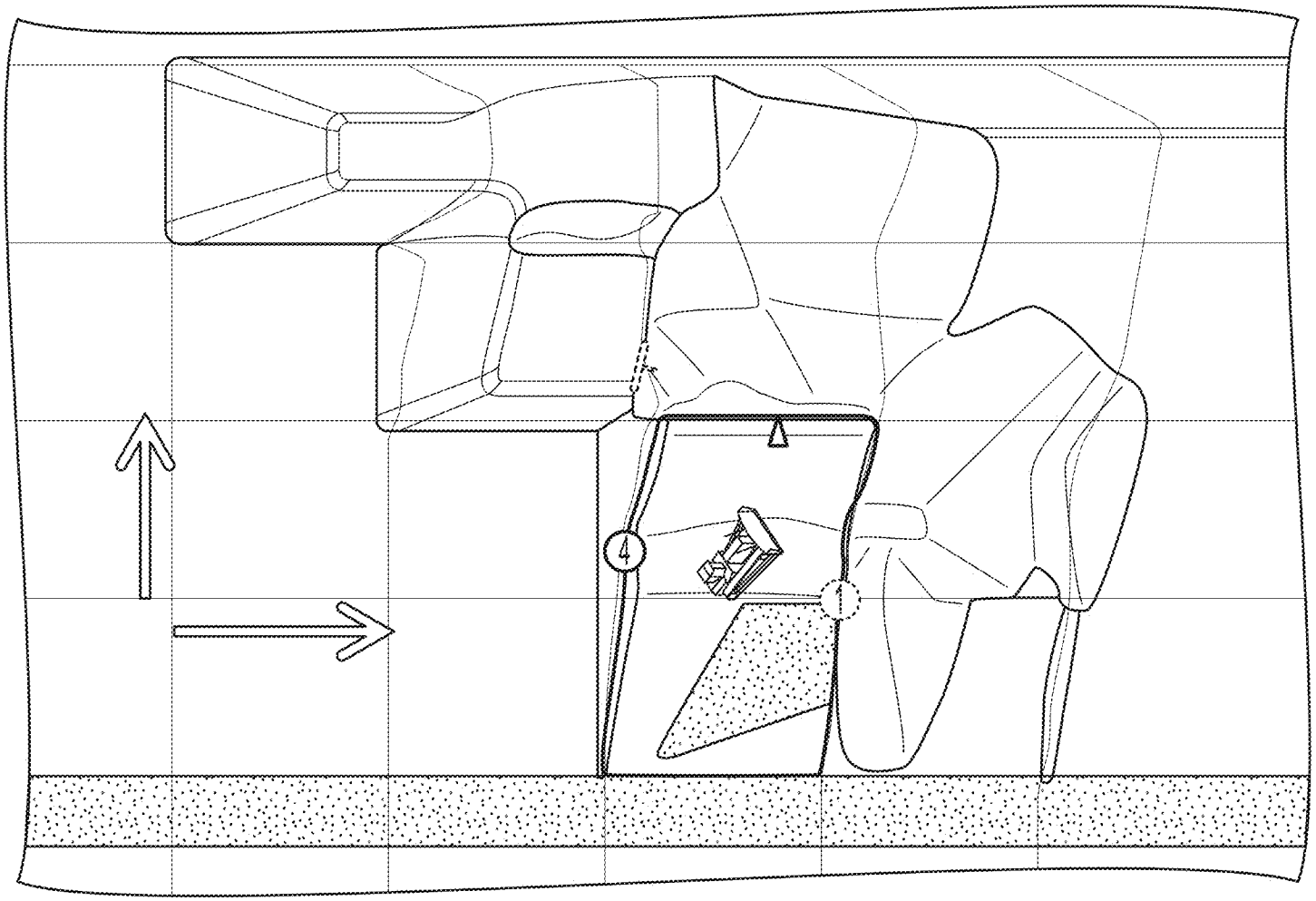

The length and the width of each block does not have to be the same length or dimension (see FIG. 11).

The method can also be used when using a predominately straight strip mining face. The waste rock in this application is pushed at an angle less than 90 degrees to the advancing face. The blocks are divided into an upper volume and a lower volume. The first lower cut volume is pushed at an angle less than 90 degrees to the face into the lower fill volume area. A percentage of its fill volume will be placed in front of the next cut block. The upper cut volume of this block is now pushed into the upper fill volume at an angle less than 90 degrees to the advancing face at an opposing angle to the first push. A percentage of the upper fill volume will be placed on top of the previous lower fill volume.

Figure 12:
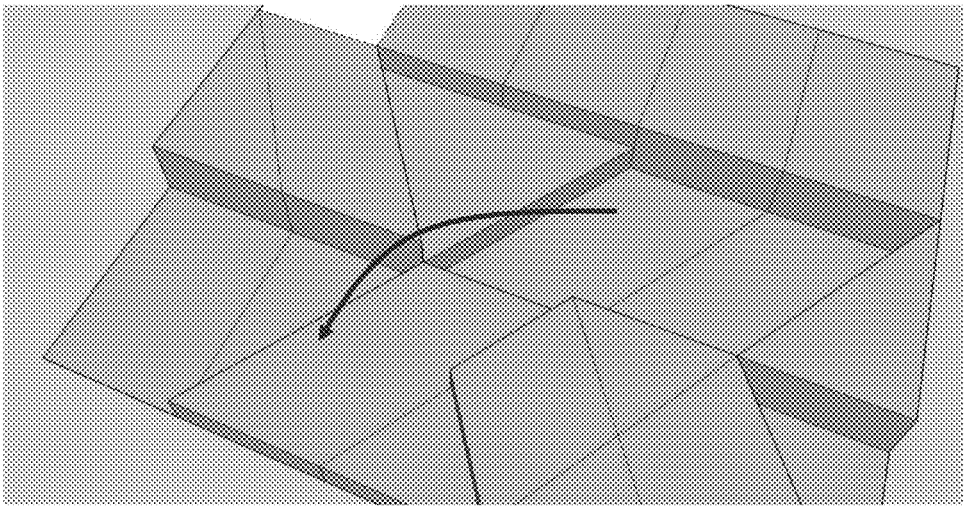
Figure 13:
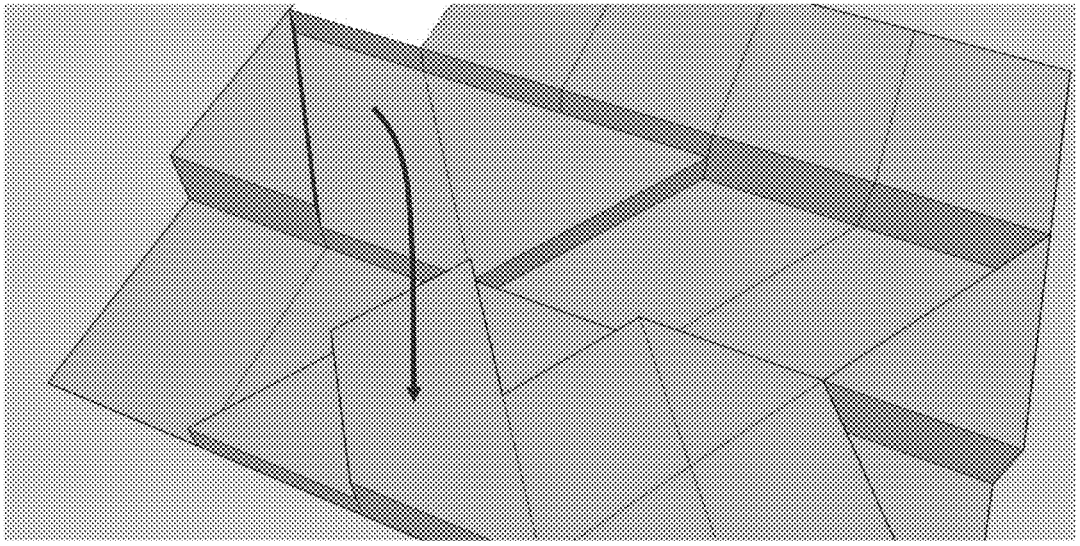
Figure 14:
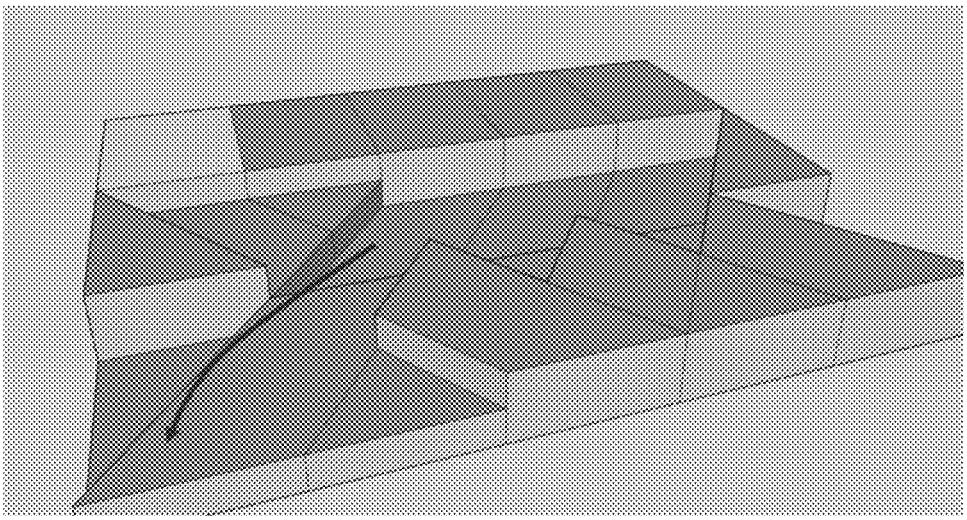

This can be repeated across the pit (see the sequence of diagrammatic FIGS. 12 to 14).

When using the method there are several advantages.

The waste removal with this method can be greatly improved by having well controlled equipment undertaking the earthworks. GPS guidance, semiautonomous, autonomous and robotic equipment can be used.

It is preferable to have a calculated push path sequence for dozers and a calculated dig and haul path for trucks and shovel operations.

It is preferable having all the equipment follow predetermined paths.

It is preferable to calculate the minimum distance and height for the waste rock to be moved from the cut position to the fill position. This may be calculated before the waste is moved or calculated while the waste is being moved. If it is calculated as the waste is being moved, the area can be continually surveyed and adjustments made to the paths for the equipment.

The planned paths can take into account the material flow as it is transported into its final fill position. It may take advantage of material characteristics and machine operating parameters.

Figure 15:
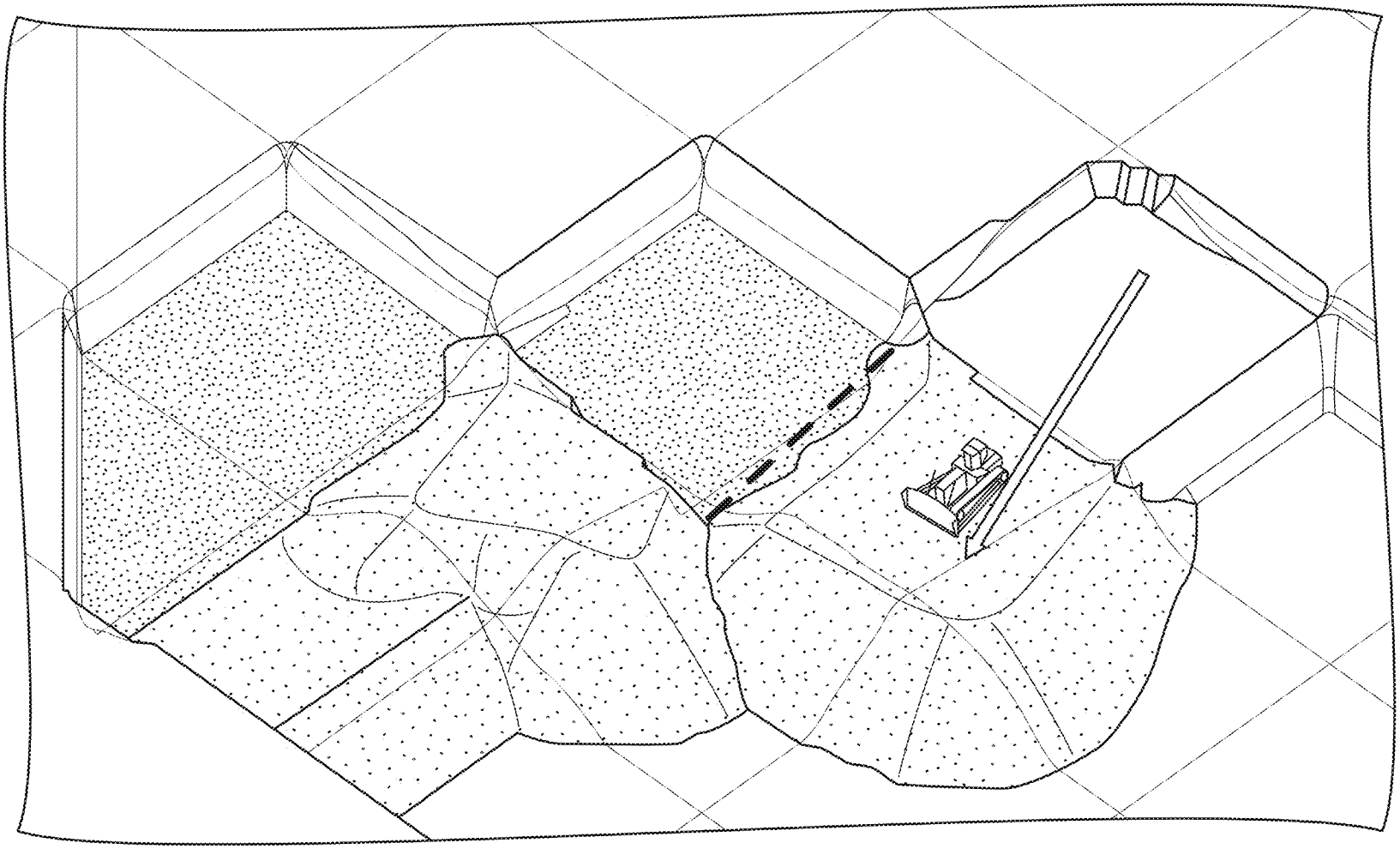

Preferably the path is calculated to reduce the rehandling of waste material that can flow back into adjacent blocks before the ore has been removed (see FIG. 15).

For the dozer operation it is preferable to calculate the push path in a series of steps and load them into the dozers control system. Each step preferably needs to take into consideration the material, the design of the pit, dozers performance characteristics and operational constraints.

The preferred push path for a GPS guided dozers will have a series of steps that are displayed as multiple design surfaces. GPS guidance systems are currently available for dozers and other earthmoving equipment. The GPS guidance system will preferably display the dozer, its work tool and other information of a design surface or work area along with the cut/fill depth and position.

Depending on the cut volume depth, the steps are preferably separated by a distance that will keep control of the dozers movements without limiting the efficiency of the dozer. Each step may have additional information displayed. Additional information can include the limits of the work area, direction the material must travel, safety information, and production rates.

As the dozer finishes step 1, step 2 will become the target step for the dozer to follow. The steps are followed in sequence until they are all completed.

It is an advantage to design the steps to improve the dozers pushing performance. In most dozer push operations the use of a pivot point is incorporated into the design. The dozer will push the waste rock from the top of the cut volume down to the pivot point and back up into the fill volume. The disadvantage of this method is that it moves most of the waste rock downwards to a low height before it has to begin pushing the waste rock up to a higher position in the fill volume.

Figure 16:
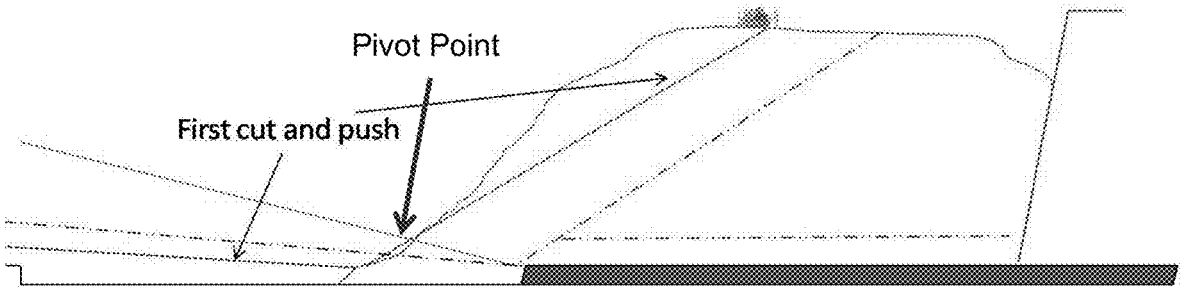
FIGS. 16-19 illustrate exemplary pivots points and dozer push plans, in accordance with aspects of the disclosure.

The pivot point is usually the point at which the cut volume will intersect the fill volume design (see FIG. 16).

Figure 17:
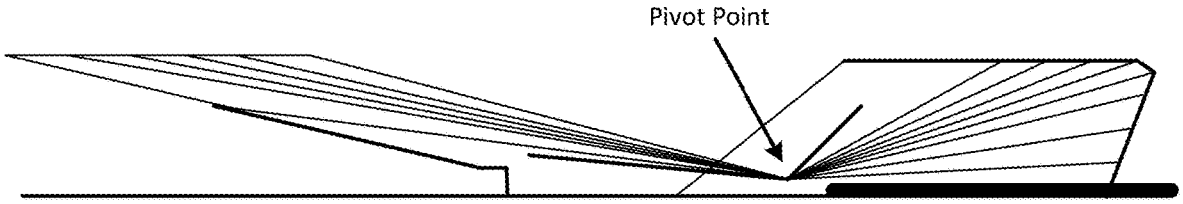

Multiple push path designs can be used in this method. It is an advantage for the dozers to follow a planned sequence reducing inefficiencies and keep the push operation controlled (see FIG. 17).

Another disadvantage is that the dozer will push more material downhill with each blade full than it can push uphill. This leads to the dozer dropping some material at the pivot point. As the amount of material grows in volume at the pivot point the dozer must start cutting at the pivot point and re-establish the pivot point. This material is called rehandle and slows production.

The present method involves designing each of the push paths to improve dozer performance by reducing the amount of waste material that is moved downwards to a low height before it is moved back up to a higher height.

Figure 18:
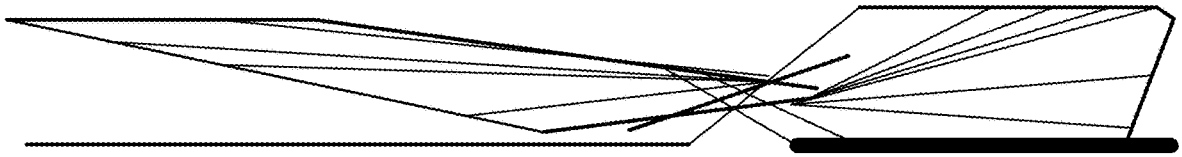

Using the present method where the dozer always pushes in one direction without pushing a combination of downhill pushing and uphill pushing will improve dozer performance. All the push steps are preferably calculated to have the dozer push at one angle. The steps are then rotated from downhill pushing to uphill pushing. This has the advantage of creating a bridge of material between cut volume and the fill volume reducing the amount of material that is pushed to a low height before being pushed to a high height (see FIG. 18).

While the dozer must rehandle some of the material between the cut volume and the fill volume to establish the final fill area. The added benefit of the bridge and the reduction of material being lifted from a lower height makes this method an advantage over the present method.

Figure 19:
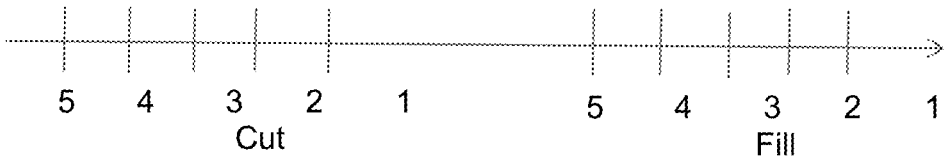

This method will increase dozer efficiency. Another benefit is to have the dozer push plan calculate the cut position and fill position for each blade full of material pushed for each step. This may be calculated before work commences or may be calculated while the dozer is moving material. The first, calculating before work commences may be displayed as a series of lines intersecting the push path. Each line representing the position of the cut, in the cut area, and the corresponding line representing the dump position in the fill area (see FIG. 19).

One way the calculation may be made while the dozer is operating is to have the control system start a push cycle with the first cut the dozer makes, compare the cut to the cut volume and deduct it from the cut volume. The cut volume that the dozer takes can be calculated from the position of the dozer or work tool compared to the starting cut surface. The blade can now move a full volume. A calculation on the position in the fill volume area can now be made, giving the dozer a cut to fill transport path. A calculation based on the path can now be made on the return position for the blade to begin the next cut position. The dozer and control system can continue to calculate the next cycle based on the previous cycle. Design limits, dozer performance and material characteristics can all be used to calculation the path of each cycle.

While a number of push paths can be displayed on each step, it is possible to highlight the nearest push path when the location of the dozer is known.

It is an advantage to calculate the designed push path and present push path. The present push path may be a projection of the dozer's present course. Comparing the two will give the control system data to make adjustments and to make adjustments to have the dozer return to the designed push path.

The present method can be in the form of a computer implemented method and system.

In another aspect the present invention broadly resides in a computer implemented system using the above mentioned method including earth moving equipment;

a processor adapted to calculate earth-moving steps described by the above mentioned method, said processor operatively controls the earth moving equipment; and one or more sensors to provide inputs for the processor, said inputs including GPS and gradient;

wherein the earth moving equipment is operated in accordance with the above mentioned method and the inputs from the sensors.

The features described with respect to the first aspect also apply to the system aspect where applicable.

The movement of earth by the dozing method described above can be facilitated by a method of strategic blasting. The use of strategic blasting preferably reduces the amount of earth to be mechanically excavated to expose the ore seams. Furthermore it preferably facilitates the dozing method by casting material in the direction that the dozers will need to push the material, separating and dealing with the upper and lower layers of material differently, and or directing material to a position that allows the formation of a ramp or bridge to transport excavated material out of the mining area.

The method of strategic blasting involves placing explosives at two or more locations, arranging the explosives at each location and coordinating the timing of the detonation of the explosives so to maximize the casting of the material to assist the abovementioned dozing method. The two or more locations can be locations at different depths at the work site, spaced locations to effect casting of site faces in different directions and locations that involve a combination of vertical depth and horizontal spacing positioning. With the strategic placement of explosives, selected volumes of earth from horizontal and vertical layers at the work site can be strategically cast to assist in the dozing method.

Examples of the method of strategic blasting are provided below.

EXAMPLE 1

Figure 20:
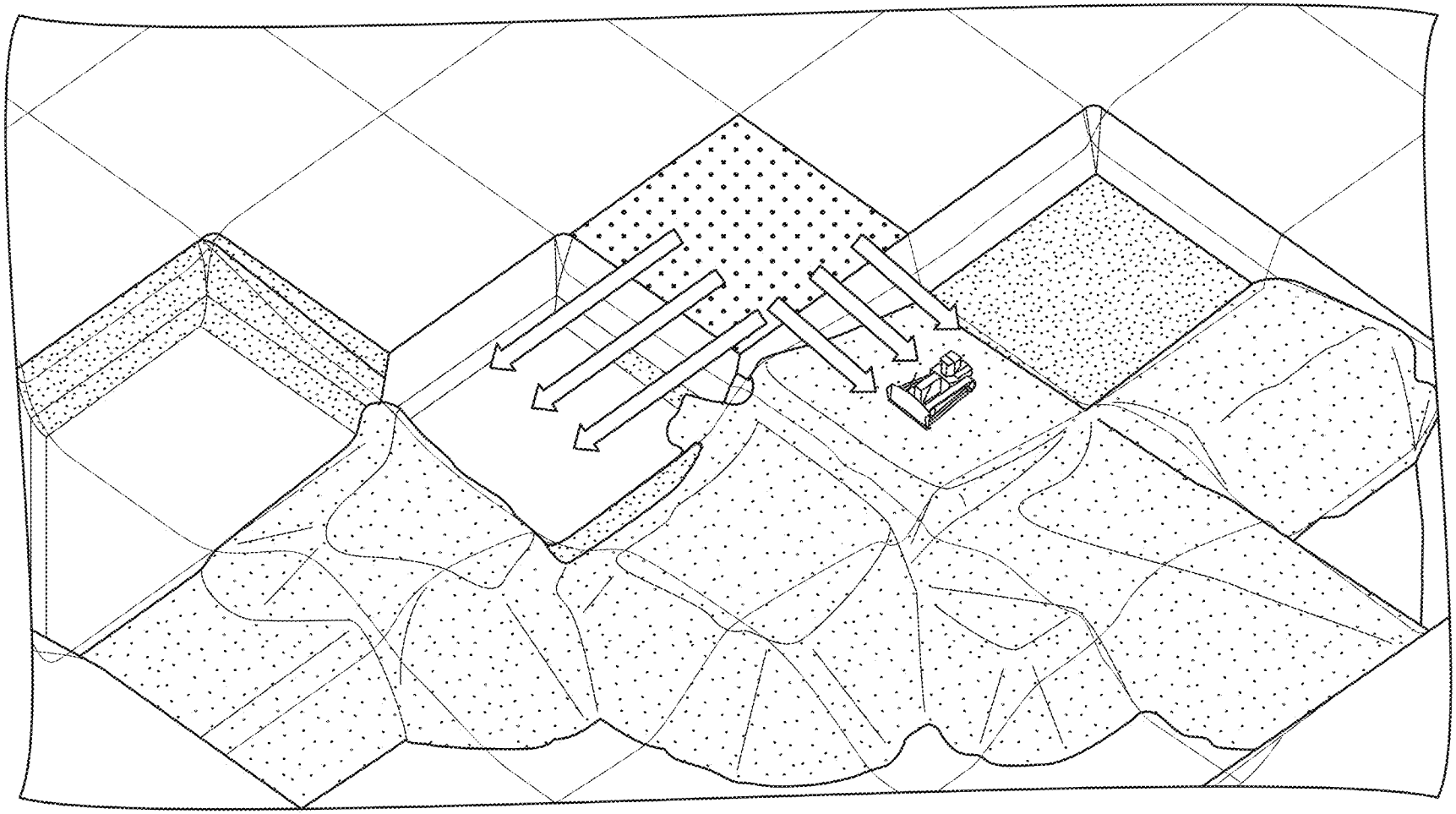
FIGS. 20-32 illustrate exemplary work sites, in accordance with aspects of the disclosure.

The cross push mining method can be improved with a blasting methods that cast material in the direction of the excavation to be undertaken. With a dozing operation it is an advantage to have the material blasted towards the direction the dozers will need to push the material. This may be in different directions or in one of the directions that the dozers will push. For example the blast can move material towards the dozing direction wherein the top of the blast casts material towards the top dozing direction and the bottom of the blast casts material towards the bottom dozing direction (see FIG. 20).

EXAMPLE 2

Figure 21:
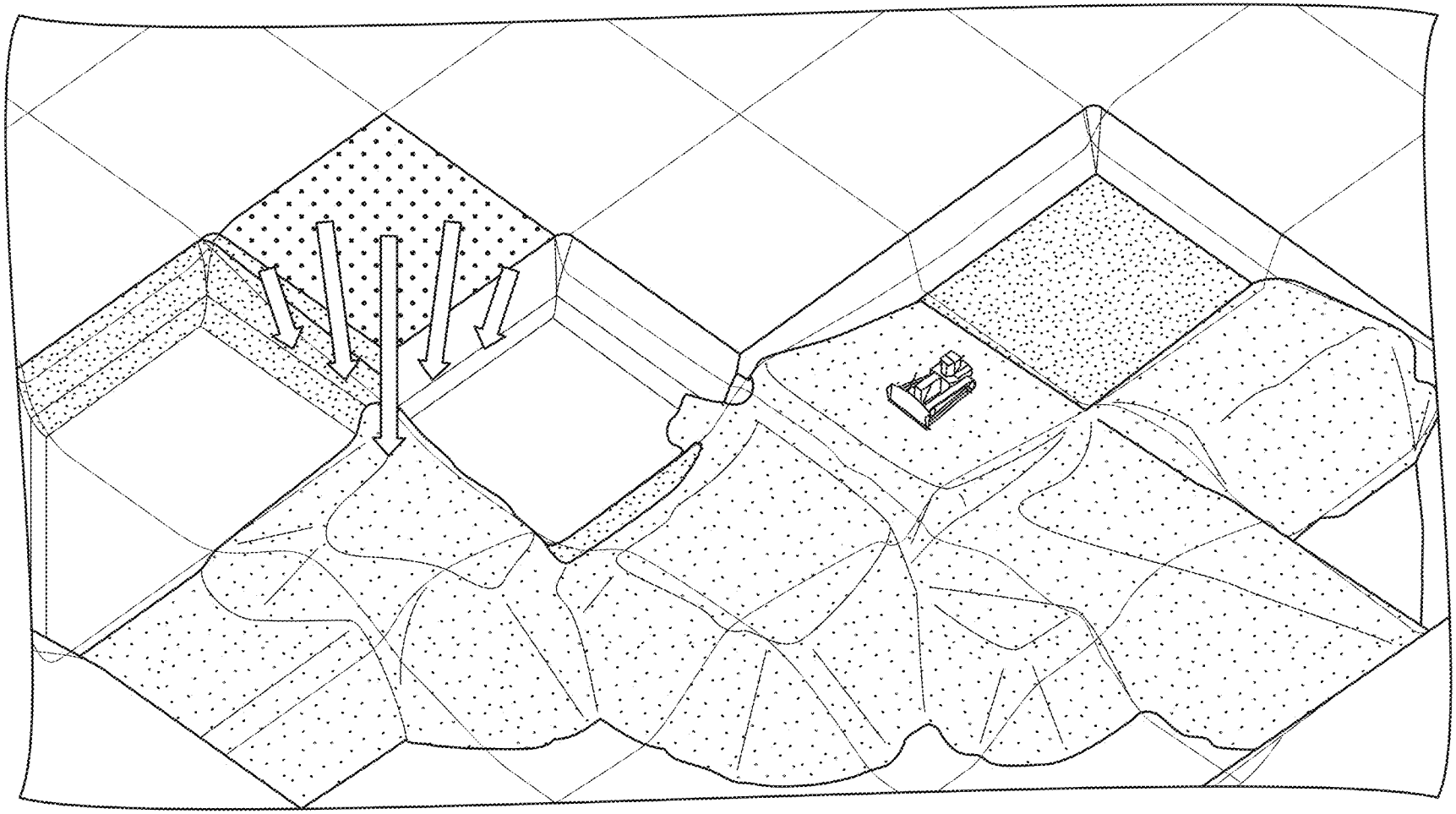

The blast method can direct cast material towards an edge to form a bridge or ramp thereby provide a short-cut and lessen the distance needed to travel by trucks and other equipment and or lower the gradient that dozers and trucks need to climb. This has application when there is need to transport material out of the mining site or the area to be excavated using a truck and shovel combination (see FIG. 21).

Figure 22:
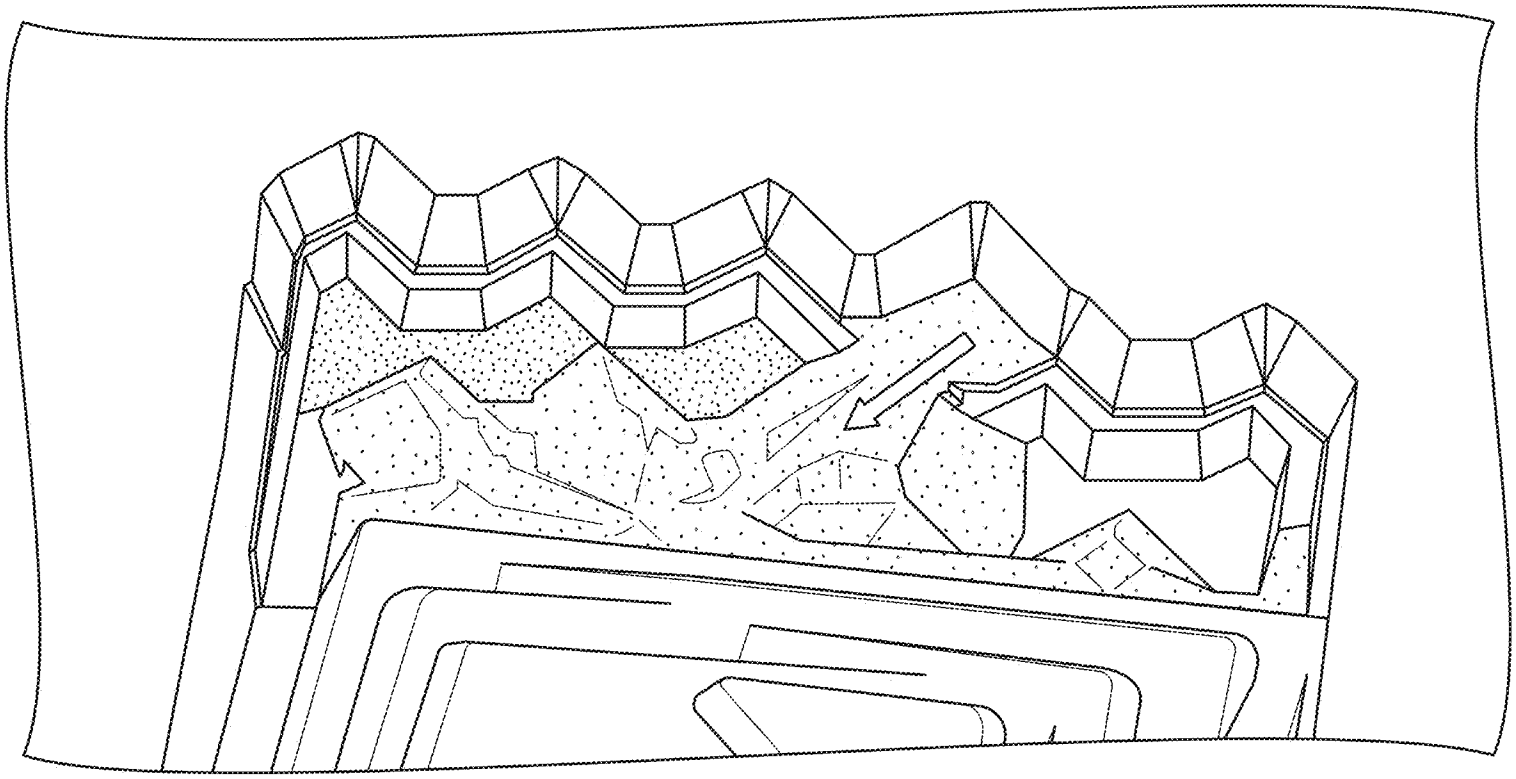

By way of example a blast that directs the material towards a direction to build a bridge will reduce the amount of excavated material needed to complete the bridge (see FIG. 22).

Figure 23:
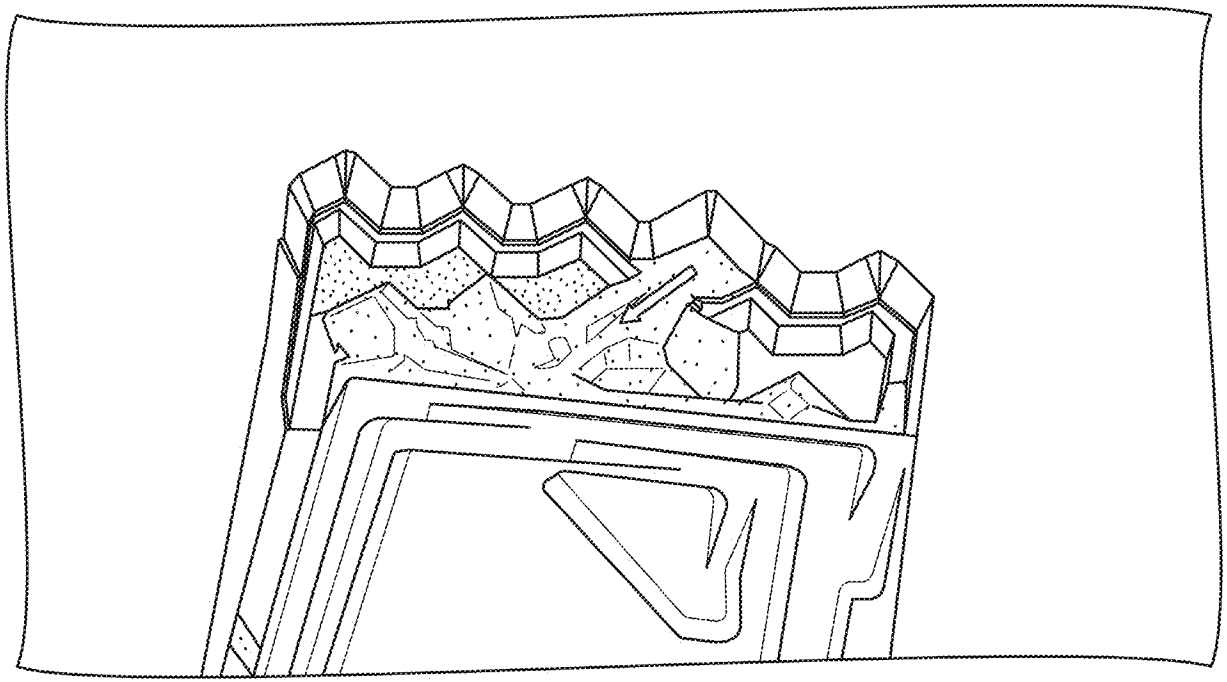
Figure 24:
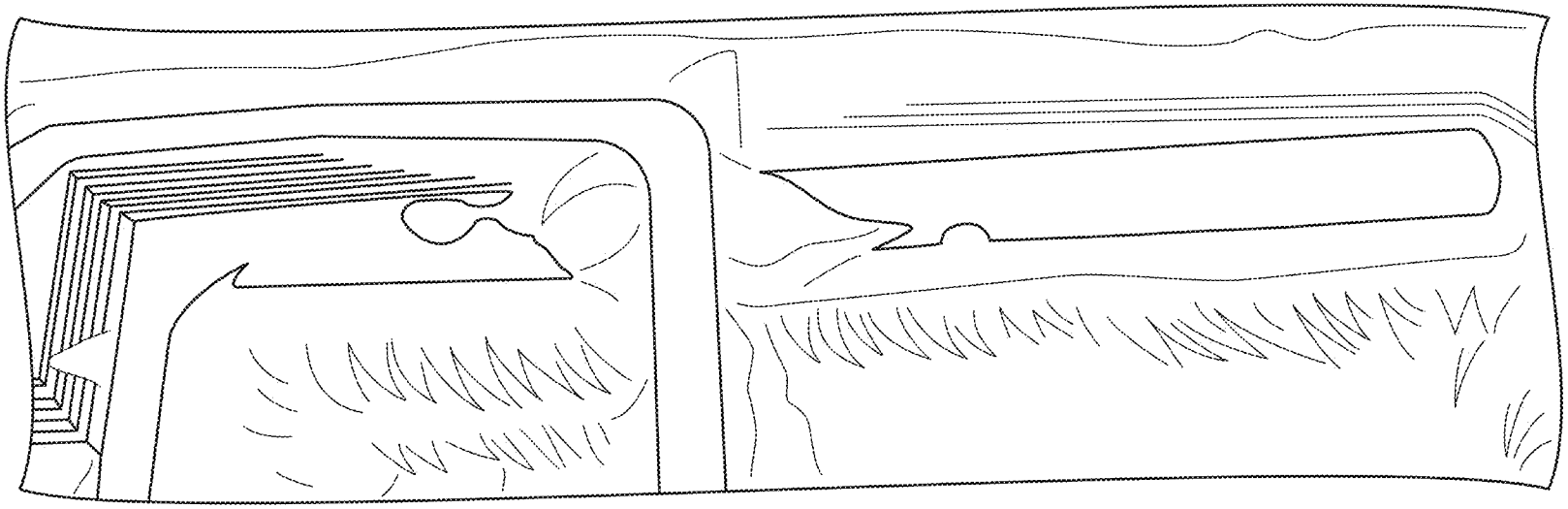

If the pre-strip material needs to cross the pit, an in-pit bridge needs to be built. The material is backfilled to build the bridge. This is of high cost as the material was removed previously. Natural bridges with the new blasting and dozing method, reduces the cost to complete a bridge that allows trucks to cross (see FIGS. 23 and 24).

EXAMPLE 3

Figure 25:
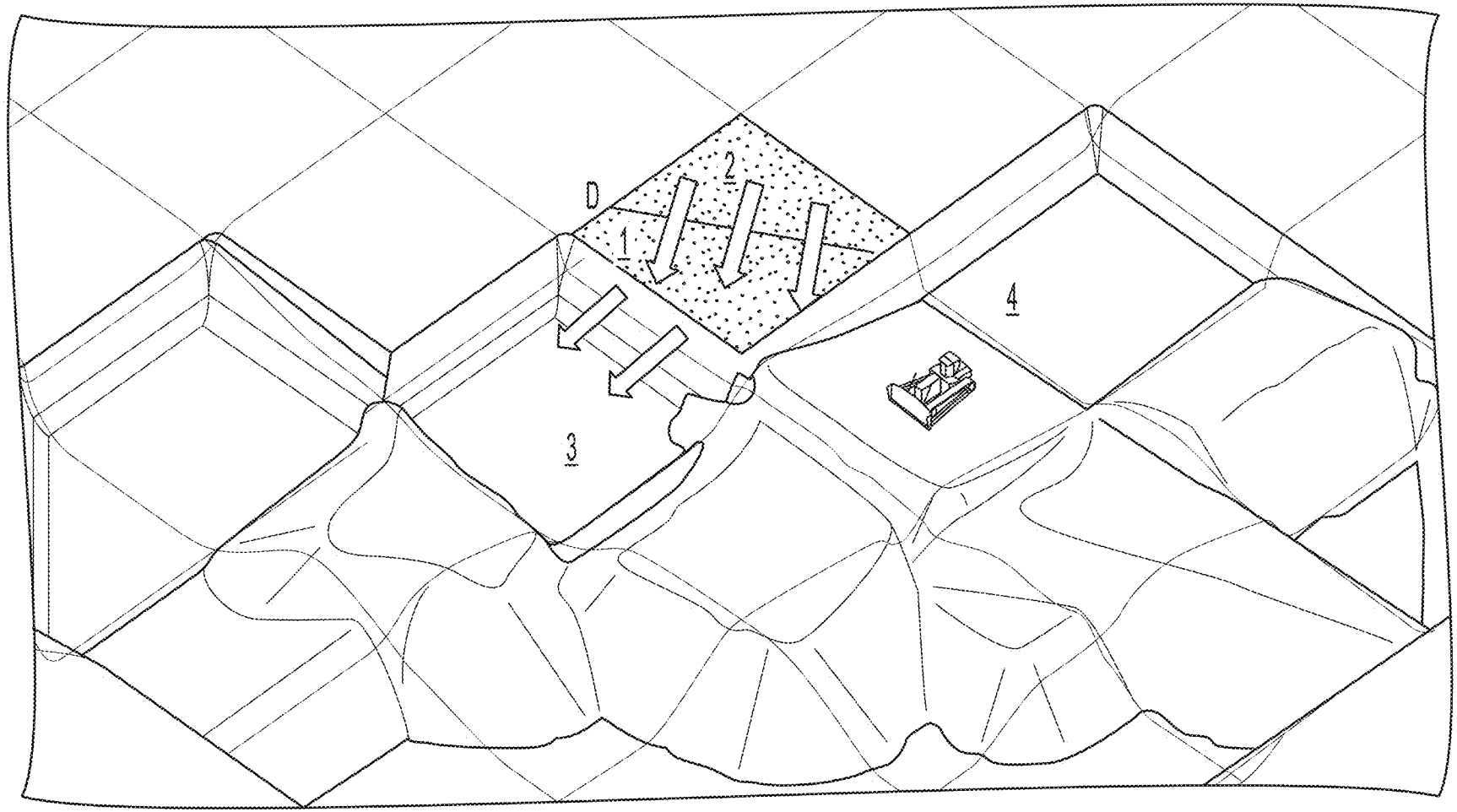

With reference to FIG. 25, the blasting of top and bottom layers (now front block) 1 is into void 3 and the blasting of top and bottom layers (now back block) 2 over the top of blast 1 is in a direction that moves the material away from void 4. The advantage of this is to reduce any material flowing back into void 4 which may still have the ore in it.

The line D that divides the two blocks may be angled to account for different volumes to be moved in each block. The plan through the blocks of line D may be angled to account for different volumes to be moved.

DETAILED DESCRIPTION OF THE PREFERRED EMBODIMENT

A preferred embodiment will now be described with reference to a three year plan for mining a coal seam in an open cut mine.

Mining Method Year One

The mine is an open cut coal mine with a single seam of coal three meters thick. The coal seam is located beneath 21 meters of waste rock material, giving the mine a strip ratio of 7:1. The mine operates as a "dozer push operation"; that is the waste rock is removed with a fleet of high production dozers. The dozers push the waste rock from the area above the coal seam into a waste dump area directly across the pit.

The mine needs to maintain saleable coal for each year of one million tons for its market. The coal weight is approximately 1.25 tons per cubic meter. That translates to uncovering 800,000 cubic meters of coal per year. The mine has been set up with a strike length of 2 kilometres. The mine will need to advance at a rate of 150 meters per year to uncover the coal needed to supply the market with some safety margin.

$$1{,}000{,}000 \text{ ton}/1.25 = 800{,}000 \text{ m}^3$$

2,000 meters strike length: 8,000 meters/(2,000 coal $m^3$/3m thick)=approximately 150 meters advance.

The mine will need to remove 6.3 million cubic meters of waste rock per year to uncover the coal needed for its markets.

The advancing blocks will be calculated with a strike length of 2,000 meters and advancing 50 meters at each time giving 150 meters of advancement for the year.

The mine first began operation as an excavator and truck operation. It was later decided to change to a dozer operation and has operated as a traditional dozer strip mine for the last three years. It has four caterpillar D11 dozers each capable of moving two million cubic meters per year as the primary waste rock removing machines. It was decided that having the dozers as a primary waste rock removal machines that some margin of extra capacity was needed. Having only three dozers would leave no room for any change in circumstances.

The coal is removed with an excavator and truck fleet. A second excavator and smaller truck fleet is available when needed to increase production after wet weather or other unforeseen circumstances. It is also used as a backup when the primary excavator and trucks are in need of repairs.

The mine is fortunate not to have hard areas that require drilling and blasting to loosen the waste rock before removal. Ripping is required in some areas but the reduced dozing time needed for ripping with the dozers has been calculated as more cost efficient than blasting.

Figure 26:
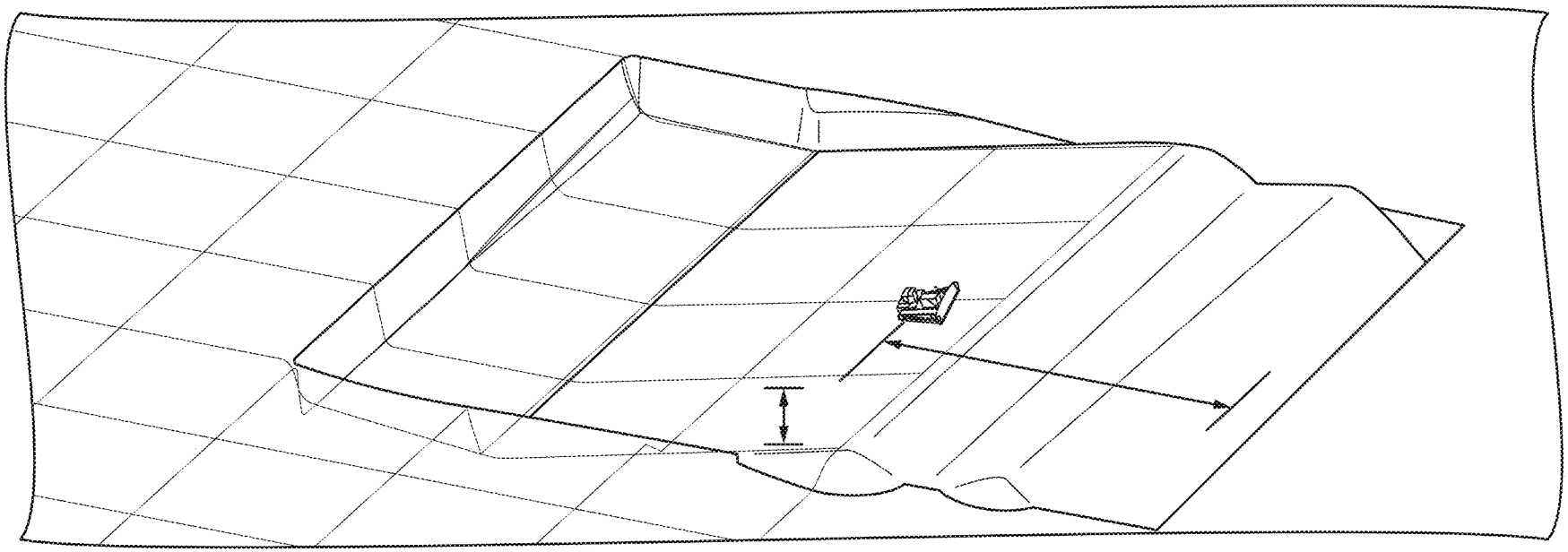

The strip mining method has to-date been a direct push from the waste rock cut area into the waste rock fill area. With this mining method the dozers start pushing the waste rock from the top surface of the cut volume and slowly work downwards to the bottom surface of the cut volume. As this is being carried out the dozer must push the waste cut volume into the waste fill volume. The top surface from the cut volume will be placed in the bottom of the fill volume. As the operation progresses, the bottom cut volume will be placed in the top of the fill volume (see FIG. 26).

It is decided to increase efficiencies of the mining operation and look at other mining methods to make higher profits.

Three mining methods are considered for this year's mine planning. It is decided to use a diamond pattern method at 45 degrees as this will result in the best mining efficiency's for pit dimensions and geology for this year's mining. It can be used with the excavator and trucks or dozers. It is decided to use the dozer fleet as they will be most effective with this method. From historical mining cost at this mine using excavators and trucks for waste rock removal, a base line cost of between $2.10 to $3.20 per BCM (Bank Cubic Meter) has been established. The dozer historical cost range from $0.90 to $1.80 per BCM for waste rock removal.

The pit is designed in a diamond pattern in a series of blocks and not in a straight advancing face. The diamond pattern is used to reduce the amount of waste rock being moved into a lower position than the height it was cut from, and reduce the amount of waste rock that is moved into a higher position than the height from which it was cut.

Another benefit is the distance the waste rock is pushed. In current dozer push methods to lift the waste rock to a certain height it must be pushed a certain distance; this ratio is a limiting factor in designing a pit for dozer push operations.

The mining engineer's produce a mining plan that will take into account the recovery rates of coal needed throughout the year. The blocks are divided into 50 meter squares in a diamond pattern along the strike of the pit. Some extra design work is needed at each end of the strike to take into consideration of only one half of a block will be used.

After the mining plan has been established, a dozer push plan is developed for each block. After the first block is established the waste rock from each block will be moved in a more efficient manner (see FIG. 27).

Figure 27:
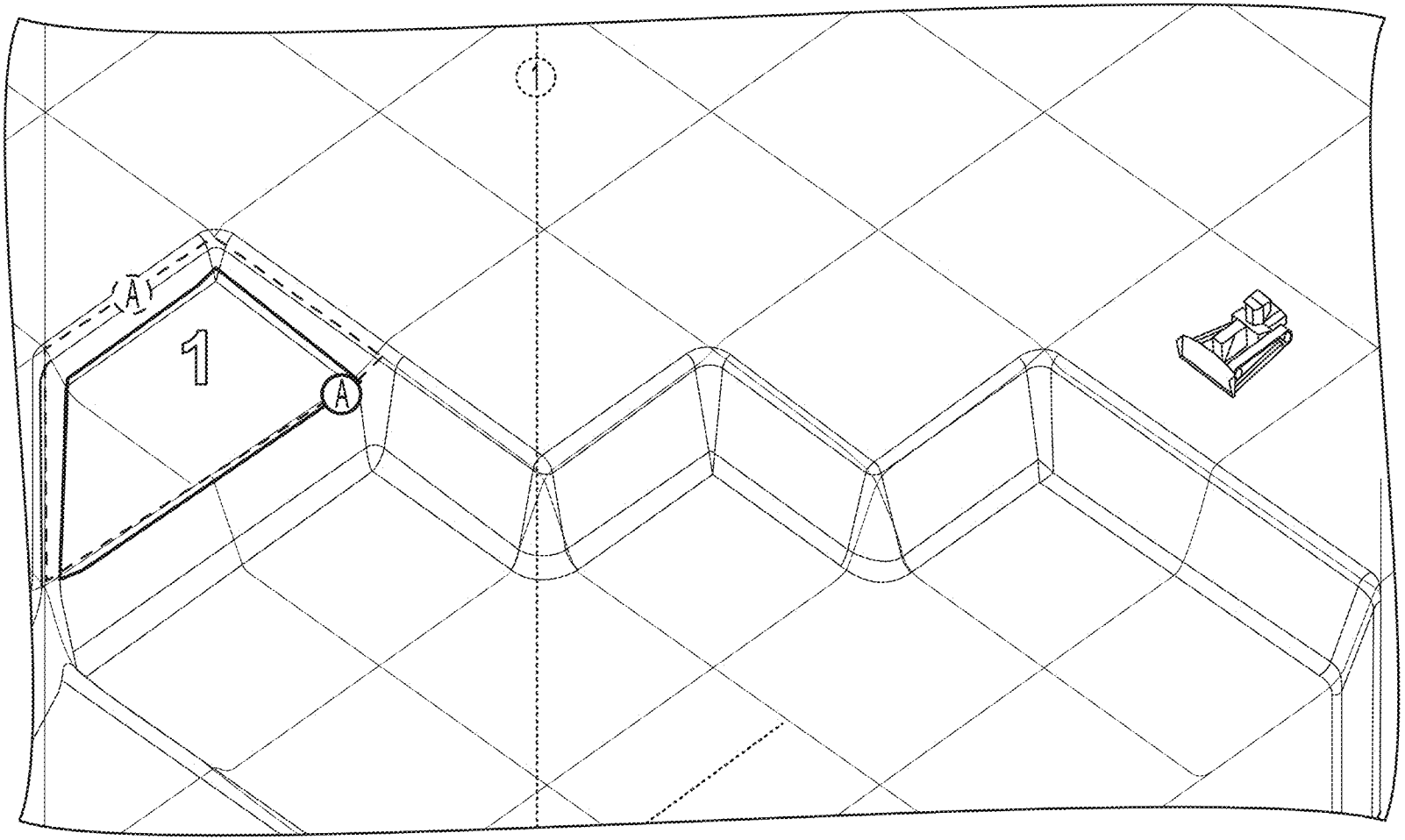

To maximise the efficiency of the method the first upper cut volume of block 1 is removed out of the pit void by pushing it to the side or removing it with a truck and shovel operation (see FIG. 27).

Figure 28:
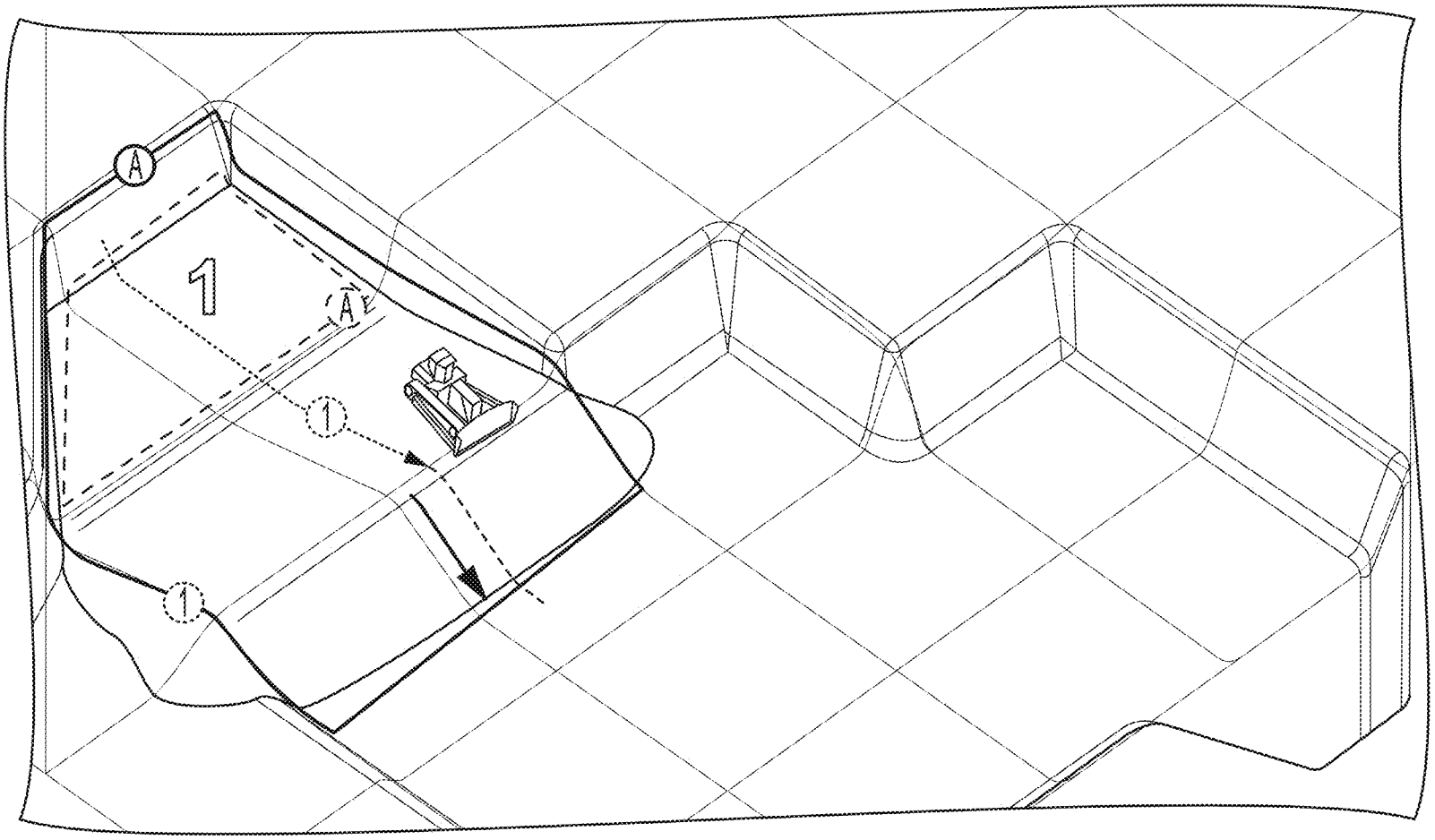

With reference to FIG. 28, the lower cut volume of block 1 is now pushed into the void created from the last mining strip or a box cut.

Figure 29:
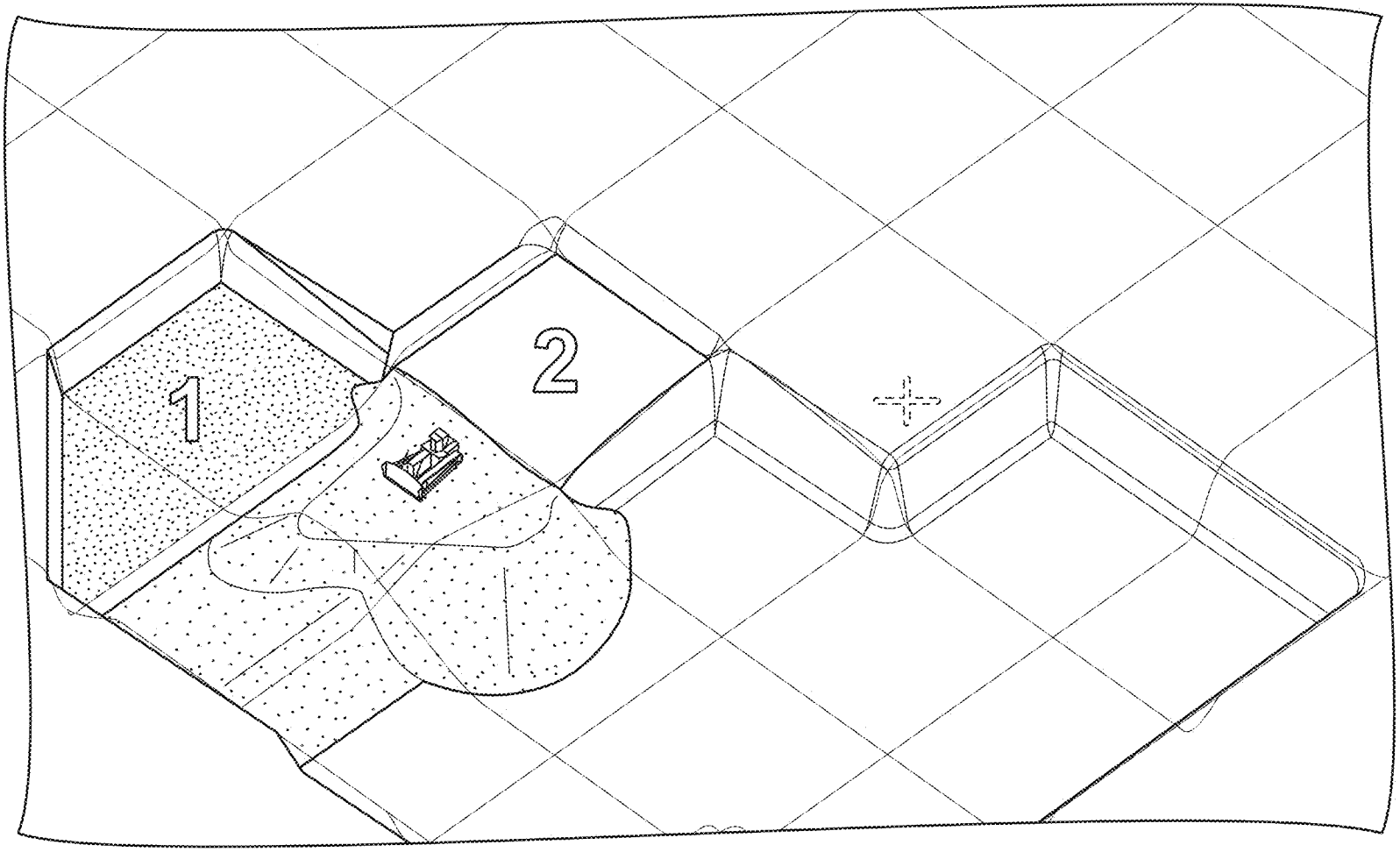

The upper cut volume of the next block 2 in now pushed across the top of the previous bottom fill volume (see FIG. 29).

Figure 30:
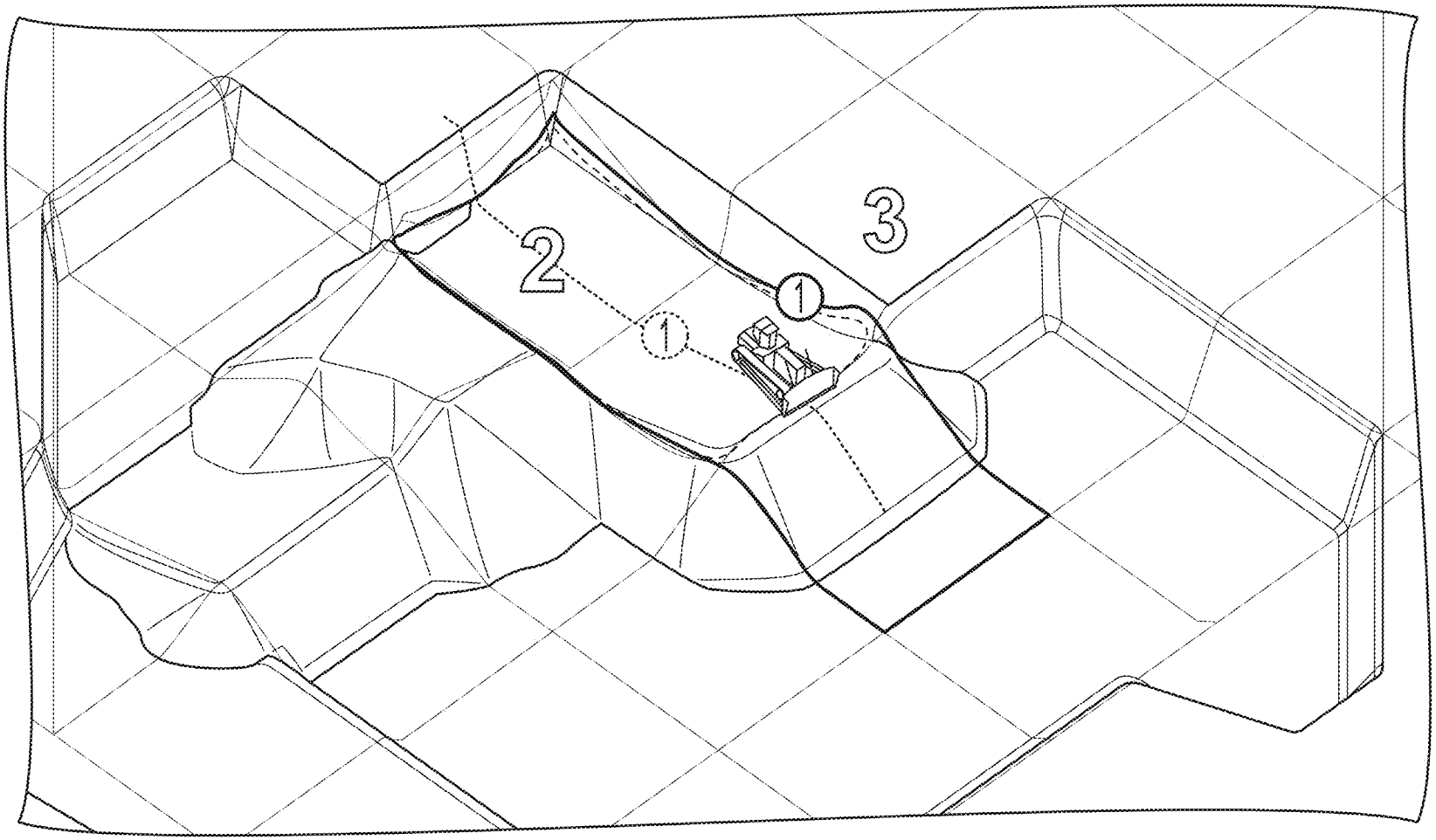

The lower cut volume of block 2 is pushed across the pit into the fill position (FIG. 30).

Figure 31:
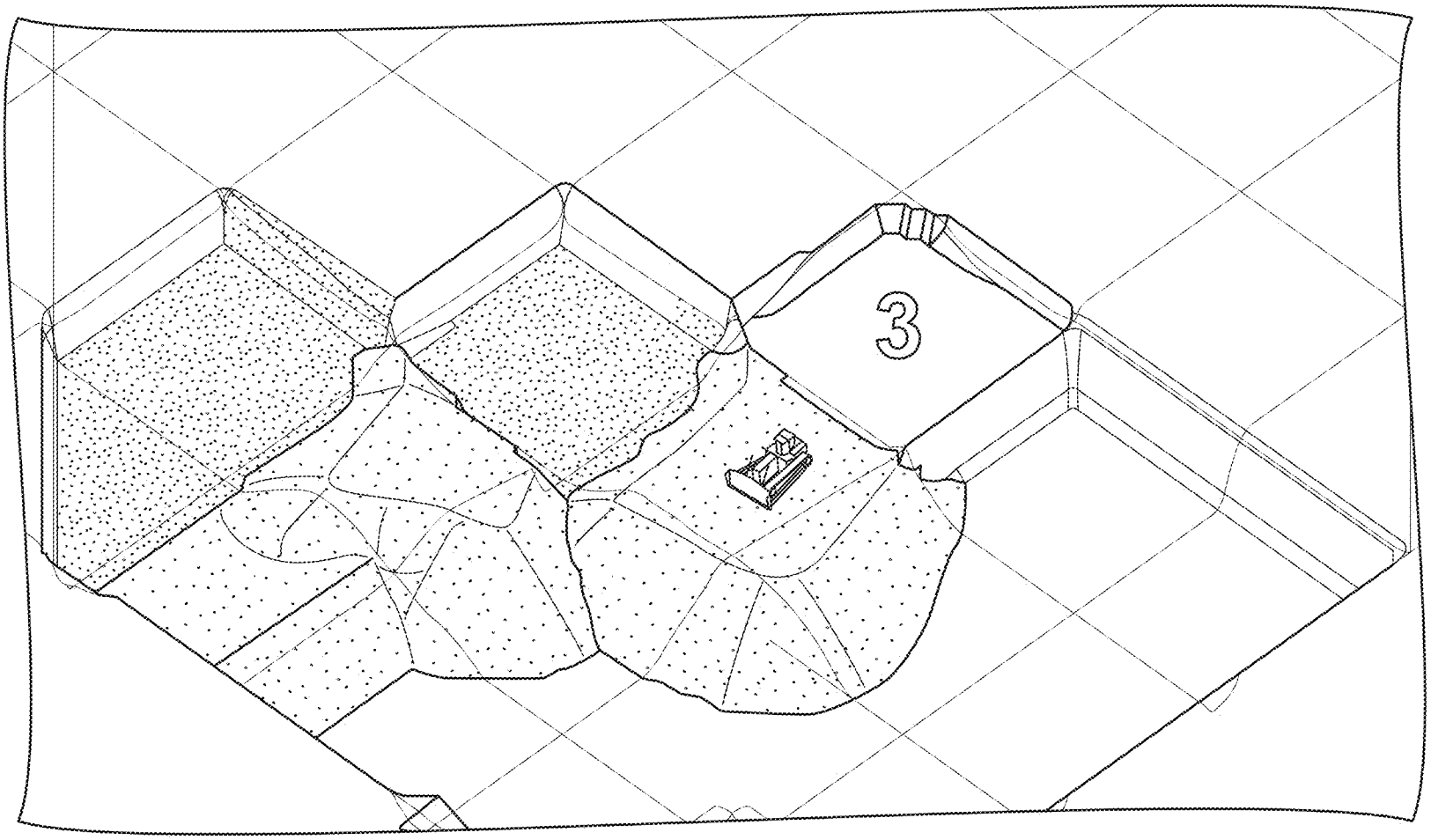

Upper cut volume of block 3 (FIG. 31) is now pushed across the top of lower fill volume from block 2. This is repeated across the length of the pit.

The dozer push plan is developed to take into consideration of the waste rock cut area and the waste rock fill area. Consideration is given to the adjustment needed in the fill area to take into account the swelling of the waste rock as it is removed from the cut area. The waste rock in this mine has a swell factor of 0.30. The rock in the ground before it is disturbed will have a Bank Cubic Meter of 1.00. After it is disturbed with blasting or digging it will have a Lose Cubic Meter volume of 1.30 meters.

Figure 32:
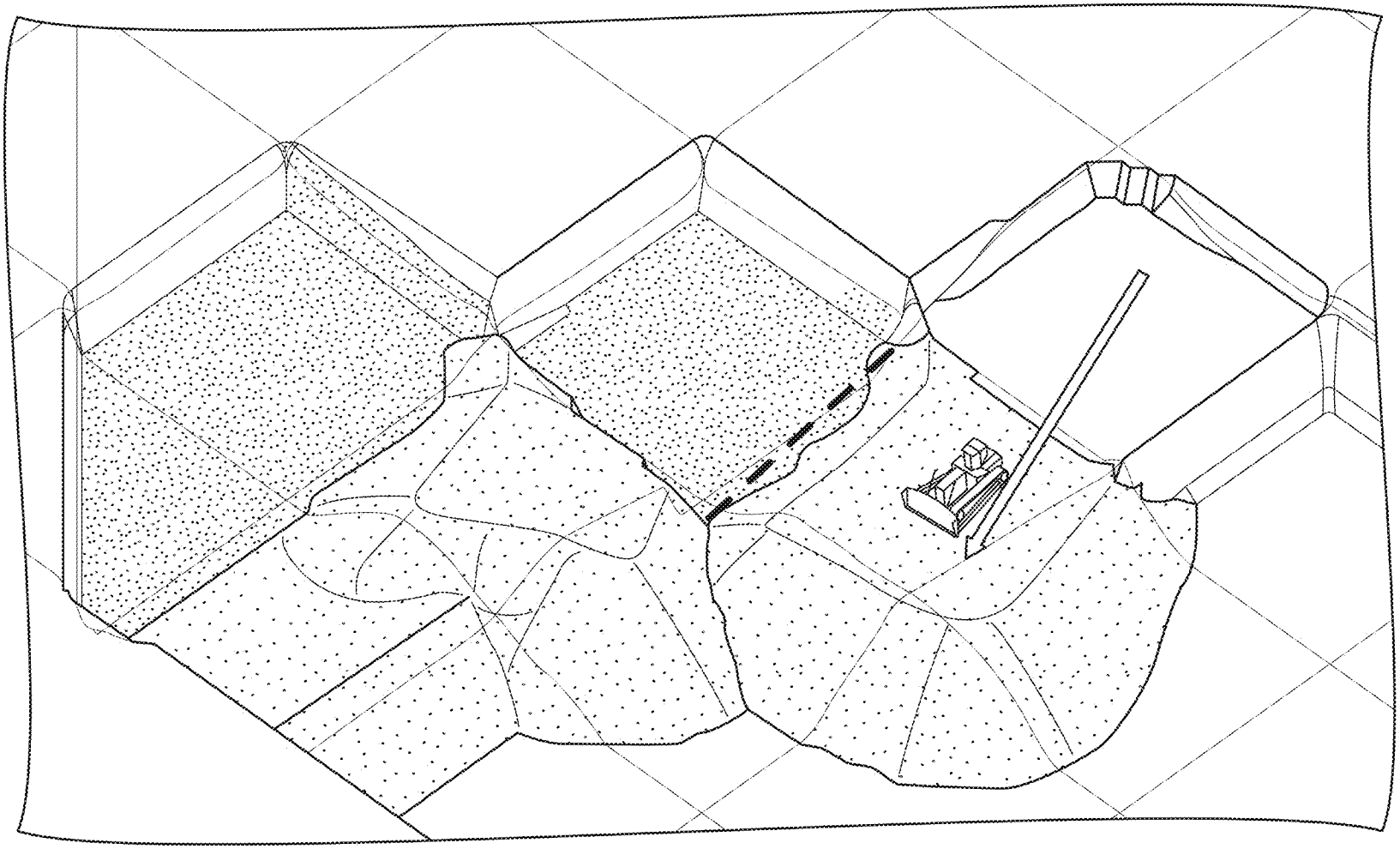

As part of this calculation, allowance for swell factors and material repose angles are used to identify boundaries that material will travel to from the fill area when it is pushed into place to eliminate waste rock flowing onto the exposed coal ready for recovery (FIG. 32).

As part of the calculation for dozing in this method the dozing distances and dozing angles are a significant cost if they are not contained to shorter lengths and less step angles.

A dozer pushing up a steep grade can push less material than a dozer pushing along a flat surface or pushing down hill, thus the movement of material up a slope takes longer and subsequently costs more. The cost and time required to move this volume can be calculated using the average push distance and gradient.

Figure 33:
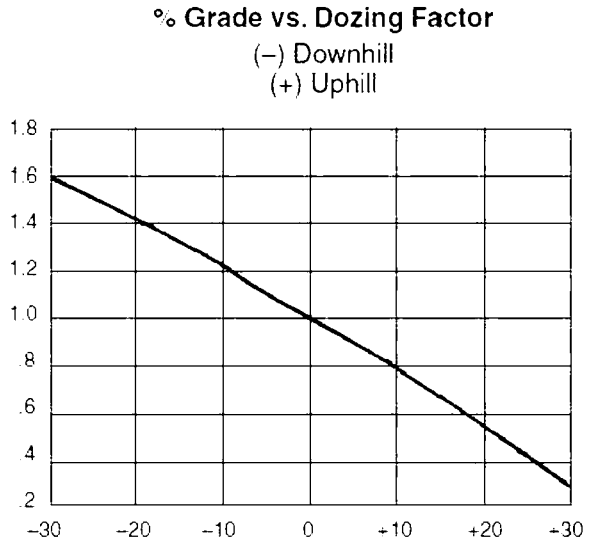
FIG. 33 illustrates an example % Grade vs. Dozing Factor graph, in accordance with aspects of the disclosure.

As the angle increases the production rates decrease, as the angle decreases the production rates increase. The graph in FIG. 33 can be used to make the calculation.

The production rates will increase by 60% for downhill pushing at 30% grade using 0% Grade as the base line and decrease 70% for pushing up a grade of 30% or 17 degrees.

The cost difference can be explained in the following example. A dozer push rate of 400 $m^3$ per hour at 0% grade. If the dozer has to push uphill at 30% grade the rate will need to be adjusted by multiplying 400 $m^3 \times 0.3 = 120$ $m^3$ per hour. If the dozer pushes downhill at 30% grade the adjustment will be 400 $m^3 \times 1.6 = 640$ $m^3$ per hour. The difference between the two is 520 $m^3$ per hour or an increase of 533%.

To reduce costs and increase the rate at which material is moved the engineers will use the diamond method and reduce the vertical distance that material must be moved by pushing "low dirt" low and "high dirt" high.

The typical straight push method results in material being pushed from the lowest cut point (top of coal) to the highest fill point (maximum dump height).

To determine the most efficient dozer push method of a selected cut area and dump area, the surveyed start surface, designed final surface and machine data are inputted to a programmable processor.

Figure 34:
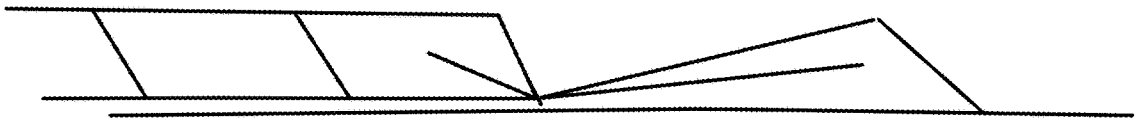
FIGS. 34-37 illustrate exemplary dozer push plans, in accordance with aspects of the disclosure.
Figure 35:
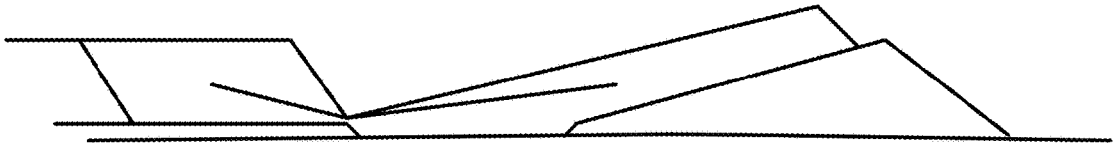

The programmable processor generates a cross section through the start and final surfaces and uses average push length and gradient to calculate an estimated cost and machine production for a range of different push methods. The production estimates for each of the methods can be compared to determine the most efficient method for the selected cross section. A push plan, which the machine operator can follow, is then produced with the software. Straight push block 1 is shown in FIG. 34 while straight push block 2 is shown in FIG. 34.

Figure 36:
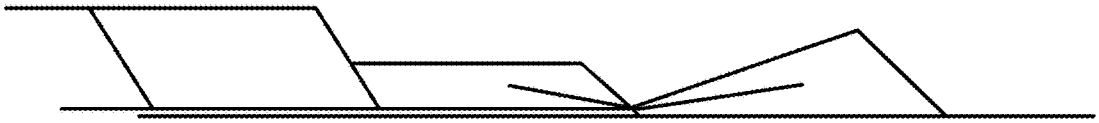
Figure 37:
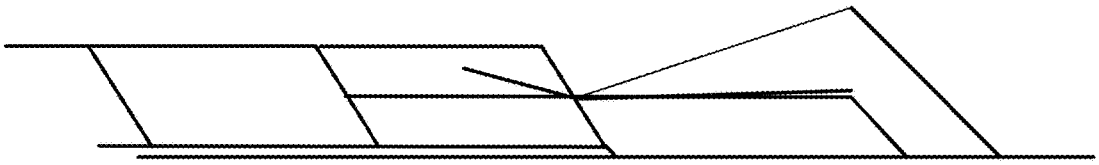

In FIG. 36 (45 degree low section push) and FIG. 37 (45 degree high section push), the 45 degree method utilises a diamond pattern to allow the top half of a block to be pushed over the dump of the lower half of the previous block resulting in a shorter less steep push.

With reference to FIG. 38 (straight push data) and FIG. 39 (45 degree angle push data), there is shown a push length comparison between straight and 45 degree angle pushes. It is shown that the average push lengths and distances are greater for the straight push method. The data is a comparison of 50 m×50 m×21 m blocks.

As the waste rock is removed from the coal, recovery of the coal can start to take place. Ramps into the pit have been designed as part of the year's mining plan. Once the first 50 m×50 m block is removed and the coal exposed the excavator and trucks can begin to recover the coal. The mining plan has calculated that the dozer fleet should finish the next block as the coal recovery nears completion from the first block.

Figure 40:
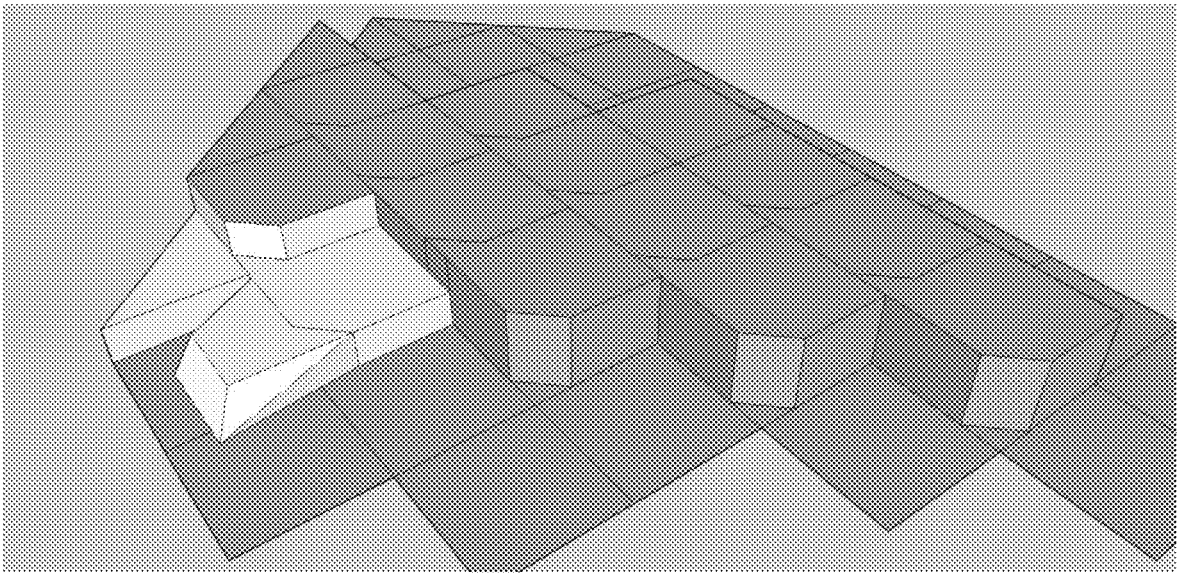
FIGS. 40-41 exemplary dozer push plans, in accordance with aspects of the disclosure.
Figure 41:
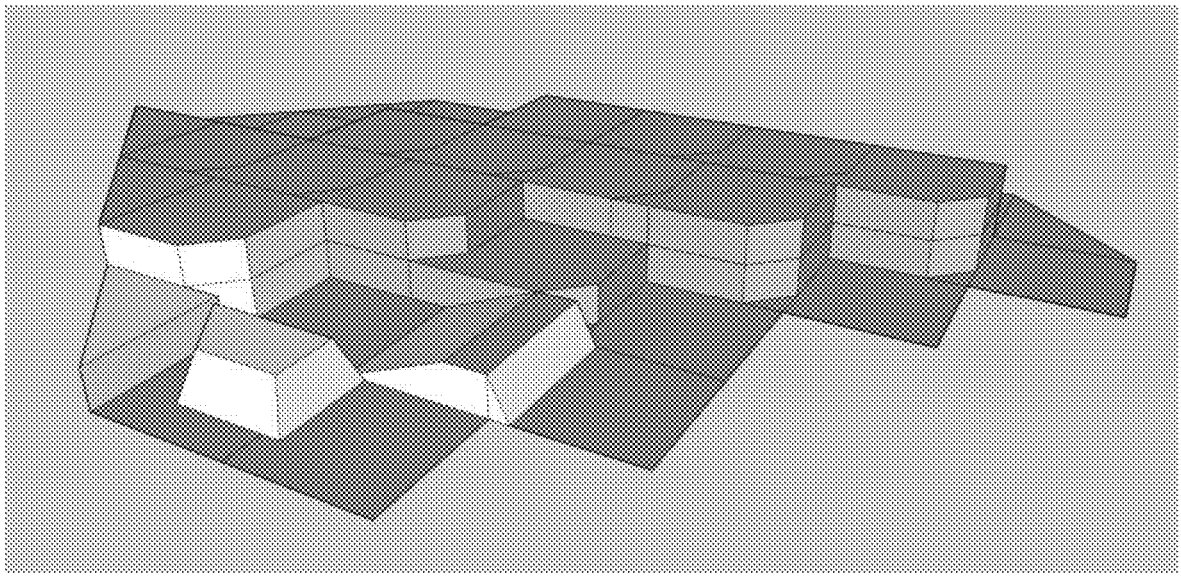

To allow access along the strike for the trucks to travel a corner from each block is removed as part of the dozers push plan (see FIGS. 40 and 41).

Mining Method Year Two

As the year closes the next year's mine planning is being prepared. From the drill hole samples and logs taken in the advancing area of the mine, it is noticed that the coal is beginning to dip downwards and later in the year it will approach a dip of 11 degrees. To uncover the coal needed for sales a change in mining methods may be needed as costs will increase with the deeper coal.

Three methods are considered: straight dozing, diamond pattern at 45 degrees and straight diamond pattern at 90 degrees. It is decided that the diamond pattern at 45 degrees will be most efficient until the coal dipping angle increases to 10 degrees. At that point the mining method will change to a diamond pattern at 90 degrees.

Figure 42:
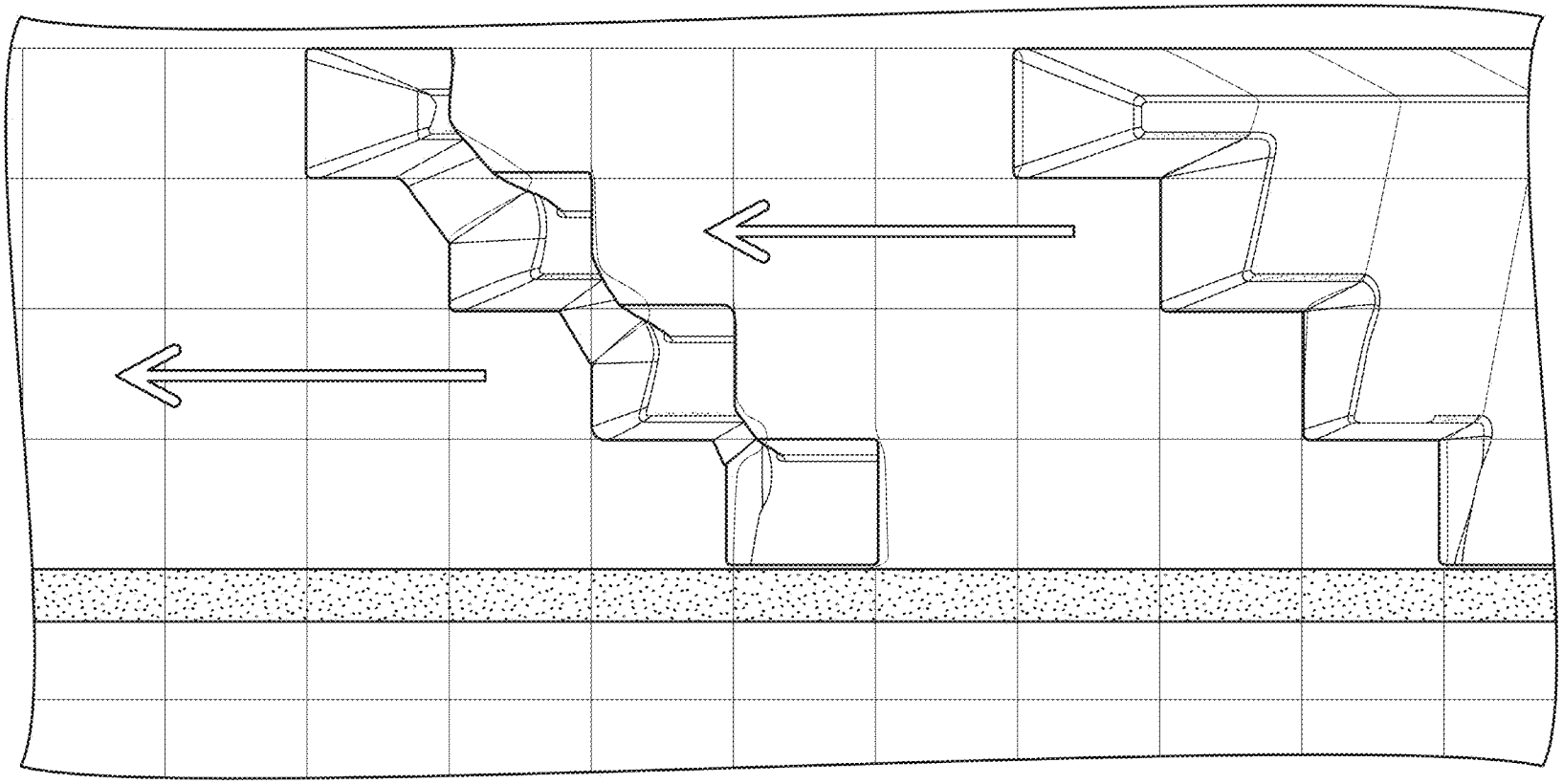
FIGS. 42-47 illustrate exemplary work sites, in accordance with aspects of the disclosure.

The 90 degree pattern method has the diamond pattern parallel to the advancing mining area with the mining cut areas mined in a diagonal pattern. These usually have the mining area advancing from an end of the pit (FIG. 42).

Figure 43:
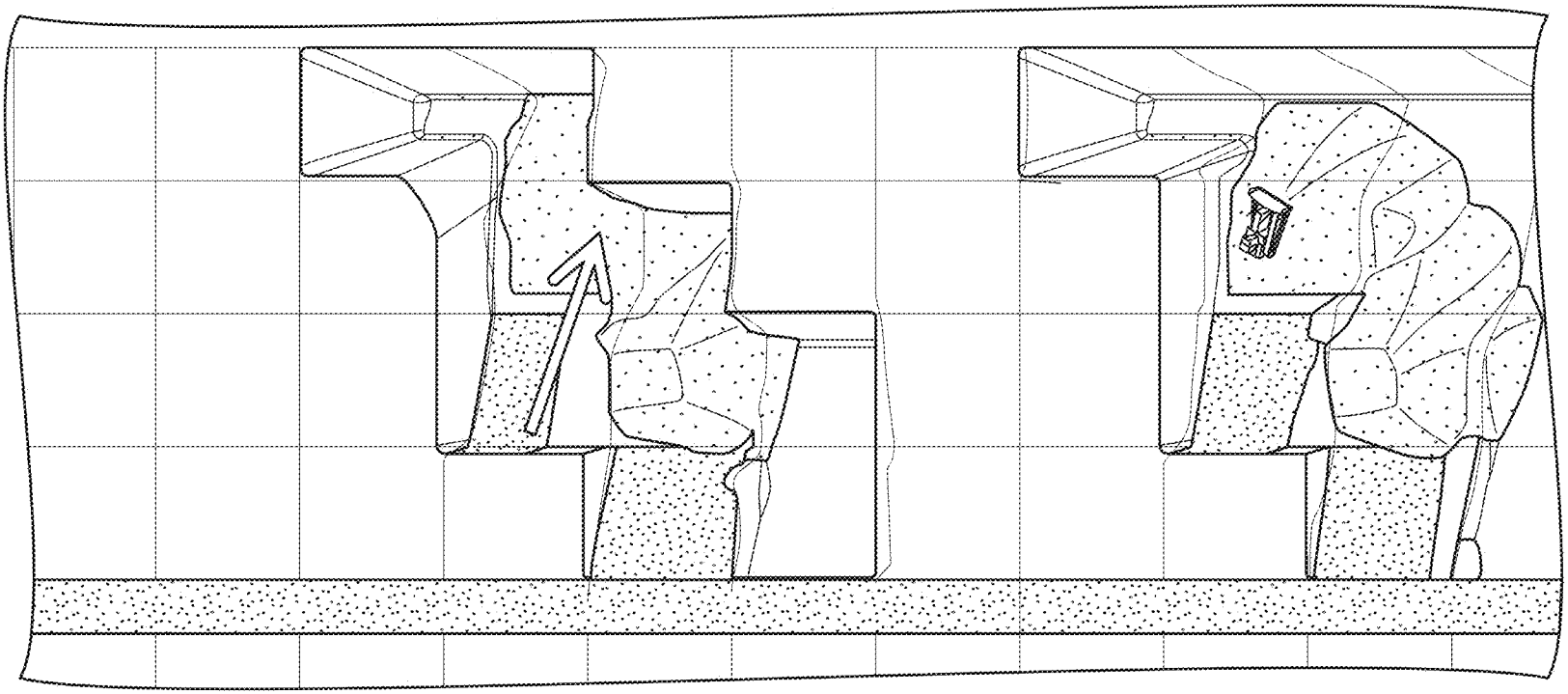

The advantages to this method when used on dipping ore bodies is that the sequence can take advantage of downhill pushing. A dozer's efficiency will increase by as much as 60% when the dozer is pushing down hill at 17 degrees. The advantages can only be obtained if the fill area is significantly lower than the cut. Having a dipping coal seam has this advantage if the pit can be designed to take this advantage (FIG. 43).

One disadvantage of mining steep dipping seams with truck and shovel operations is that the dip may be greater than 10% needed to drive a loaded truck out of the pit with either waste rock or mined ore. Ramps are needed to make roadways for the trucks and must be cut into the waste dumps or the cut volumes above the ore body.

Figure 44:
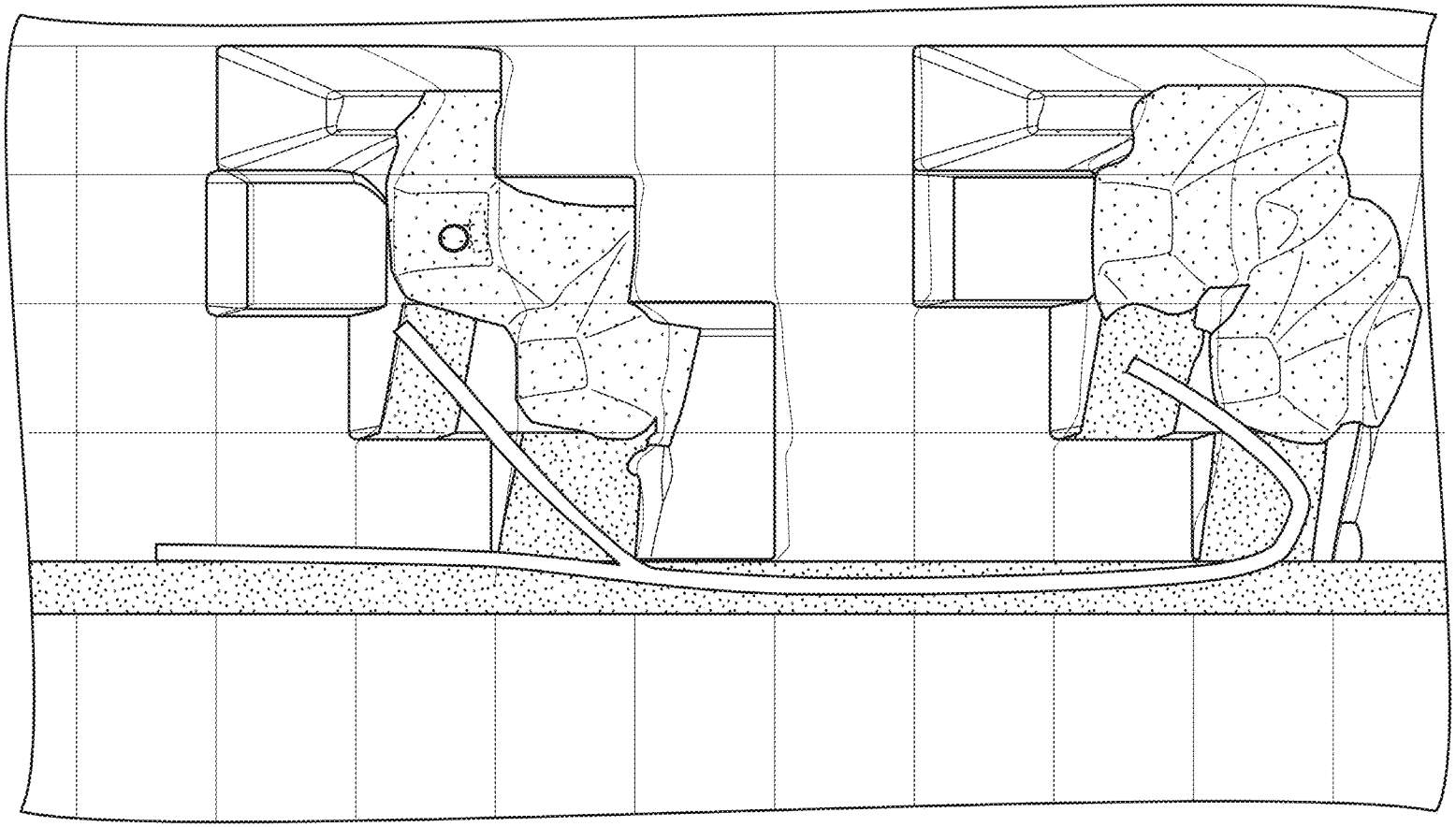

An advantage of the 90 degree method is the blocks can be arranged so that the diagonal corners from one cut volume to the next lower cut volume are less than the maximum ramp angle for the trucks to drive out of the pit. This will allow the trucks used to recover the ore to use the void created as a ramp out of the pit (FIG. 44).

Figure 45:
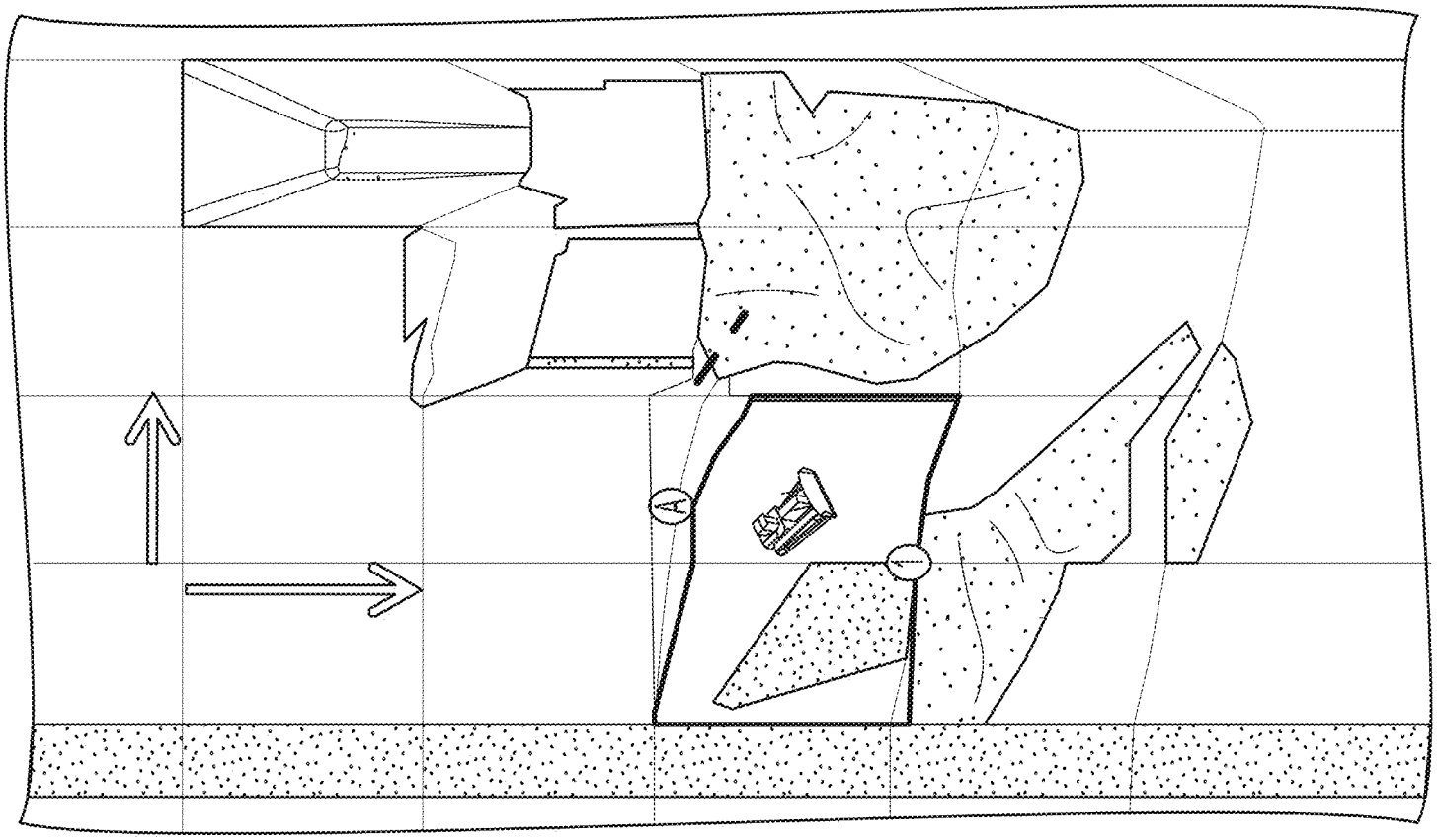

This method will give the mining operation some flexibility as the coal dip increases, by using the area behind the blocks as ramps to recover the coal. As the dip increases, the blocks can be lengthened along the strike to maintain a maximum of 5.7 degrees (10%) ramps for coal recovery (FIG. 45).

The 90 degree diamond pattern will prove higher production rates over the 45 degree diamond pattern as the dip increase by taking advantage of the higher dozer production rate for more downhill pushing. The advantages of this method will rely on setting the pit geometry to having multiple work faces. The engineers have calculated that the excavator and truck fleet will be required to establish the change over from 45 to 90.

Figure 46:
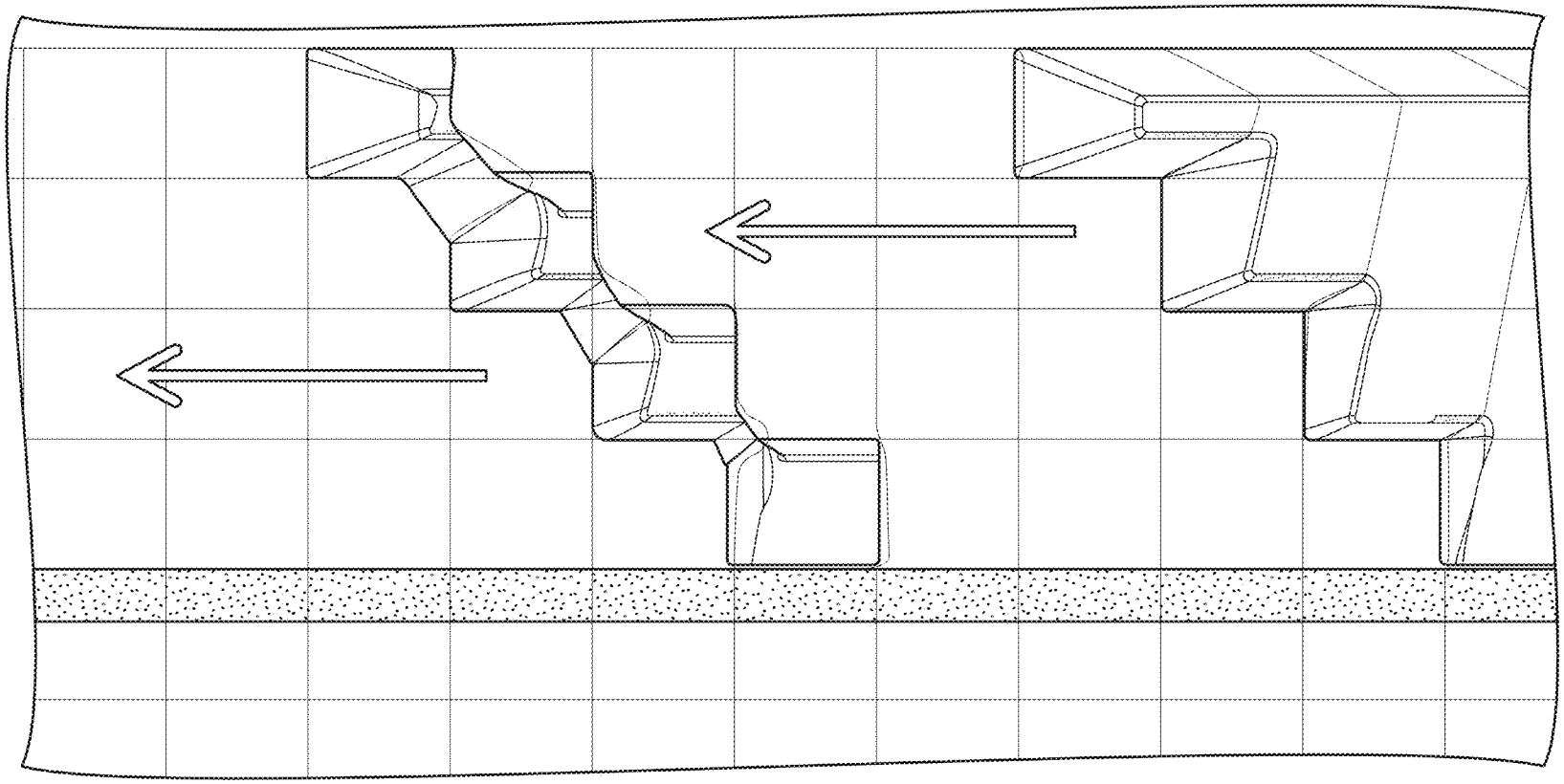

Although this will take some time to complete a schedule has been draw up to have the excavator start at the end of the pit the dozers have completed. The schedule has shown only a small time delay in having coal exposed for recovery and the economic justification shows a cost reduction in operating expenses for the year as compared to continuing with the present 45 degree diamond pattern. There will be some disruption to coal recovery rates with a period of time when no coal will be recovered. It has been calculated that by utilizing the second excavator and truck fleet and increase some work hours that coal recovery will be re-established quickly and the total years coal production will be meet. The marketing department has informed the customers and they are satisfied with the total tonnage being delivered for the year (FIG. 46).

To take full advantage of this method and to keep the coal recovery rates in line with coal needed for sales, two advancing pit openings are established. The first is opened at one end of the pit and the second is opened in the centre of the strike. This will have the two opening approximately 1000 meters apart. After established, the mining plan will have the dozers working from the bottom side back towards the top side. While this is an advantage for the dozers to be always pushing downhill, the coal cannot be recovered easily until the dozers have reached the last top block. Having two openings will allow the dozers to complete one section and then move to the other opening while the excavator and trucks remove the coal from the section completed. The secondary excavator and trucks will be used to establish the bottom block cut to start the next dozer push sequence. The process will be repeated with the dozers and truck fleets moving from each area as they complete their work.

Figure 47:
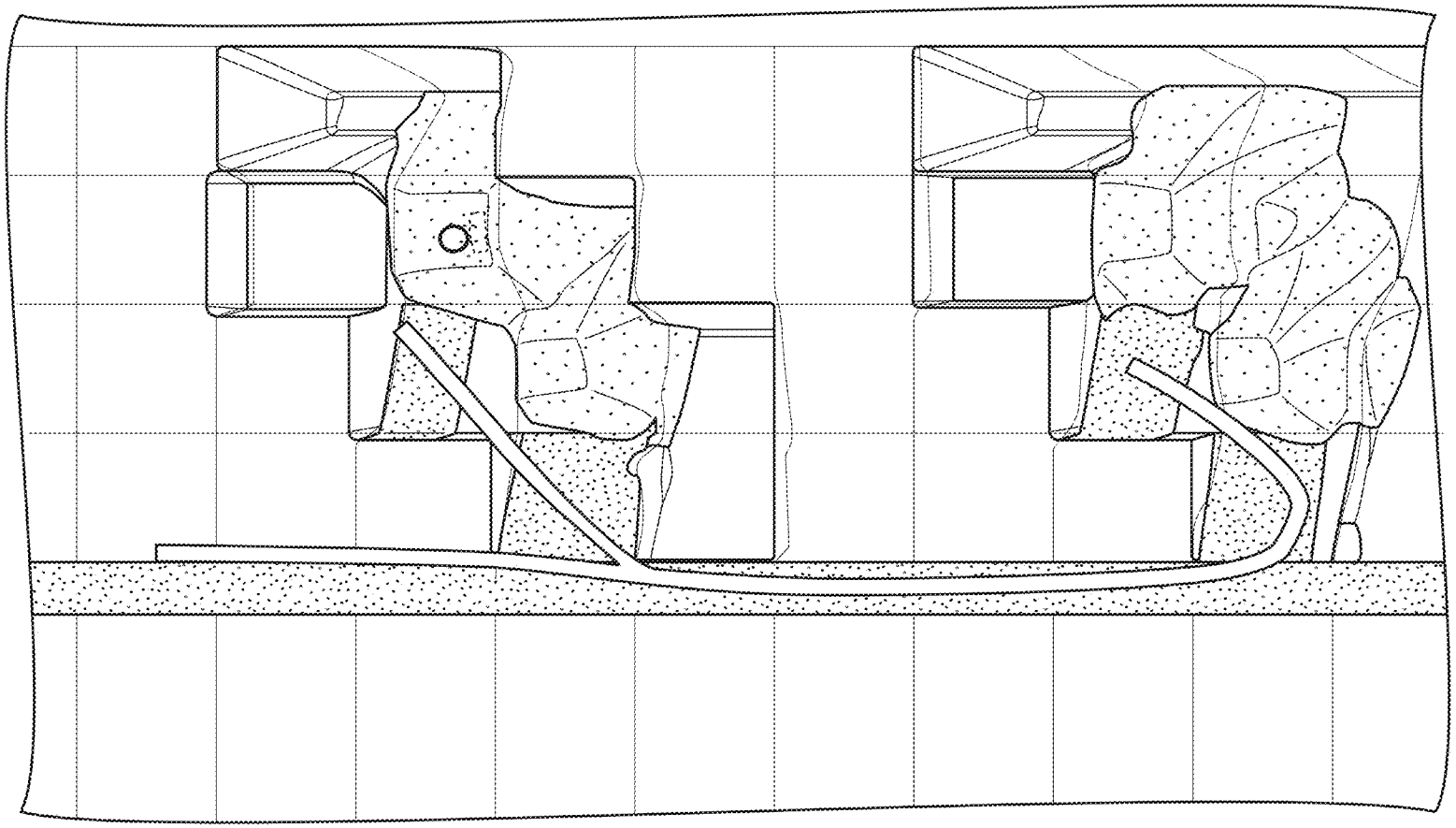

The distance between the two openings is not too great and the movement of slow heavy equipment from one opening to the other has been calculated into the cost benefits modelling (see FIG. 47).

The method also has the cost benefit of reducing the ramps required. The slope down the dip along the path created by the blocks can now be used for the ramp access into the coal recovery area.

Mining Method Year Three

In the following year (year three) the coal seam is continuing to dip below 10% but will not exceed 20% for the remaining minable area. The 90 degree diamond pattern will need to be adjusted by adding the secondary excavator and truck fleet to remove the top of the waste rock.

Adding the extra capacity of removing the waste rock with the second excavator and truck fleet before the dozing begins with the 90 degree diamond pattern has been calculated as the most efficient use of the mines present mining equipment.

It has been calculated that if the mining depth continues to increase the cost effectiveness of the dozers will decrease. With the added depth now growing to 40 m the dozers will need to push longer distances and at a higher grade. As the dozers are limited to pushing the waste rock into the fill area by the angle they can push up at, this will mean longer push lengths. The fill area is also limited to the previous block dimensions. The dozers will not be able to dump all the cut waste rock into the fill area. The cost will grow using dozers alone. While it will be still cheaper than using excavator and trucks, the dozers are reaching a limit they cannot exceed which is room to push the waste rock. It will be cost effective to use a combination of equipment.

As the depth of coal increases, the cost of mining will increase. The excavator and truck costs will increase with depth. There will come a time in the future that the cost increase because of increasing ore seam depth will make the mining operation uneconomical. The dependence on efficient mining methods will extend the mine life beyond the original mine plan.

The original mine plan was developed using excavators and trucks when coal prices were high. The mine had an expected life of 15 years. The cost of infrastructure and other capital was costed out over the 15 year period. The expected mine life would have ended when waste rock removal reached $2.60 per BCM in year 15. The new mining method has maintained cost under $2.60 and will continue for another 4 years past the original mine life.

The cost of infrastructure and capital can now be spread over more years giving the mine a more return on investment than first calculated. The mine set up cost was $60 million. Over the original life of 15 years equates to a yearly cost of $4 million per year. If the mine can extend its operation for another 4 years than the $60m will be spread over 19 years of operation giving a cost per year of $3.2 million (See the spreadsheet in FIG. 48).

The preferred embodiment of the method of strip mining involves dividing the pit into blocks in a diamond shape arrangement with an angular advancing strike face and removing waste material from each diagonally adjacent block so as to minimize the amount of waste material pushed by dozers and maintain the incline of ramps to gradients of 10% or less so that trucks can take mined ore from the pit.

Variations

It will of course be realised that while the foregoing has been given by way of illustrative example of this invention, all such and other modifications and variations thereto as would be apparent to persons skilled in the art are deemed to fall within the broad scope and ambit of this invention as is herein set forth.

Throughout the description and claims of this specification the word "comprise" and variations of that word such as "comprises" and "comprising", are not intended to exclude other additives, components, integers or steps.

The invention claimed is:

1. A method of strip mining to mine an ore seam including dividing a pit into a plurality of blocks where each block is orientated along a mining strike length in a diamond pattern formation to present an angular advancing strike face;

moving overlying waste material from a first block of said plurality of blocks to access the ore seam wherein the waste material is divided into an upper cut volume and lower cut volume, the upper cut volume is removed out of the pit and the lower cut volume is moved into a first adjacent pit void;

mining the ore seam in the first block;

identifying a second block of the plurality of blocks that is diagonally orientated with respect to the first block and along the mining strike length;

moving an upper cut volume from the second block to the first block and a lower cut volume of the second block to a second adjacent pit void to expose the ore seam; and mining the exposed ore seam in the second block; wherein the steps of moving waste material and mining the exposed ore as performed with respect to the second block are repeated with the remainder of the plurality of blocks.

2. A method as claimed in claim 1, wherein the first and second adjacent pit voids are behind the advancing strike face and formed from a previous mining operation.

3. A method as claimed in claim 1 wherein the method is carried out by moving the waste material a shortest distance from the pit and forming an incline ramp with a 10% gradient or less.

4. A method as claimed in claim 1 wherein a front corner of at least one of the plurality of blocks is incorporated into a further cut volume of an adjacent block to form a roadway to move ore from the pit.

5. A method as claimed in claim 1 wherein dozer and truck and shovel operations usage is dependent on a direction and a depth of the ore seam.

6. A method as claimed in claim 1 wherein the diamond pattern has the plurality of blocks orientated at 45 degrees along the mining strike length but changes to 90 degrees when a dipping angle of the ore seam increases to 10 degrees and higher.

7. A method as claimed in claim 1 wherein a length of the blocks along the advancing strike face are extended as a dipping angle of the ore seam increases so as to maintain an inclined ramp with a maximum gradient of 10 degrees.

8. A method as claimed in claim 1 wherein strategic blasting is used to reduce an amount of waste material to be mechanically excavated, facilitate a dozing by casting material in a direction that a dozer will need to push the material, separating and dealing with upper and lower layers of material differently, and/or directing material to a position that allows the formation of a ramp or bridge to transport excavated material from the pit.

9. A method as claimed in claim 1 wherein a strategic blasting includes placing explosives at two or more locations, arranging the explosives at each location and coordinating a timing of a detonation of the explosives, wherein the two or more locations are locations at different depths at a work site, spaced locations to effect casting of site faces in different directions and locations that involve a combination of vertical depth and horizontal spacing positioning, wherein the blasting maximizes the casting of the material to facilitate moving the waste material.

10. A method as claimed in claim 1 wherein the ore seam is a coal seam.

* * * * *